US009809994B1

(12) United States Patent
Neff

(10) Patent No.: US 9,809,994 B1
(45) Date of Patent: Nov. 7, 2017

(54) TENSIONALLY SECURED SCREENING PANEL

(71) Applicant: Lawrence Millard Neff, Sapulpa, OK (US)

(72) Inventor: Lawrence Millard Neff, Sapulpa, OK (US)

( * ) Notice: Subject to any disclaimer, the term of this patent is extended or adjusted under 35 U.S.C. 154(b) by 0 days.

(21) Appl. No.: 15/401,534

(22) Filed: Jan. 9, 2017

(51) Int. Cl.
*E04H 17/16* (2006.01)

(52) U.S. Cl.
CPC ..... *E04H 17/16* (2013.01)

(58) Field of Classification Search
CPC ..... E04H 12/22; E04H 12/2292; E04H 17/00; E04H 17/066; E04H 17/16;
(Continued)

(56) References Cited

U.S. PATENT DOCUMENTS 4,062,522 A 12/1977 Lepetri
D300,566 S 4/1989 Fein
(Continued)

FOREIGN PATENT DOCUMENTS

CA 2 497 860 * 8/2006 ..... E04H 12/22
WO WO 2007/126983 * 11/2007 ..... E04H 17/16

OTHER PUBLICATIONS

E-Z-Go Divjsion of Textron, Inc., Windshield Installation Instrutions [online], [retrieved Nov. 30, 2016], retrieved from the Internet ,<URL: https://ezgo.ebizcdn.com>, pp. 1-2 showing sash or Windshield Attachments and pressing the Windshield Assembly onto the canopy struts by way of the Windshield Attachments.
(Continued)

*Primary Examiner* — Michael P Ferguson
(74) *Attorney, Agent, or Firm* — The Overton Law Firm, P.C.; Tommy D. Overton, Jr.

(57) ABSTRACT

An integrally formed panel (10) comprising an annular member (15) defining a longitudinally extending cavity (16) for engaging a picket (5); at least a first distal panel (100) extending away from the longitudinally extending cavity (16) for screening; the annular member (15) having a longitudinally extending slot (21) in communication with the longitudinally extending cavity (16) for receiving and releasing the picket 5; a locking tab (74) and an anchor lock (94) along opposite sides of the longitudinally extending slot (21) for releasably and tensionally securing the annular member (15) to the picket 5, the anchor lock (94) extending away from the longitudinally extending cavity (16) and projecting angularly from the adjoining portion of the annular member (15), and the locking tab (74) extending toward said anchor lock (94); a prying means 70 for receiving a lever and prying force to releasably latch the locking tab (74) and the anchor lock (94); at most one hinge (54) between the locking tab (74) and the anchor lock (94) for flexibly opening the annular member (15) to receive and release the picket (5); at most one corner (55) adjacent the locking tab (74) for cooperating with the hinge (54) to open the annular member (15) to receive and release the picket 5; a spring (51) between the corner (55) and the hinge (54) for tensioning the annular member (15); and an anchor flange 92 adjacent the anchor lock (94) extending into the longitudinally extending cavity (16) for anchoring the annular member (15) to the picket (5) and for resisting releasably latching the locking tab (74) to the anchor lock (94) during handling, shipping, or displaying.

20 Claims, 14 Drawing Sheets

(58) Field of Classification Search
CPC ..... E04H 17/1426; E04H 17/1439; E04H 17/143; E04H 17/20
See application file for complete search history.

(56) References Cited

U.S. PATENT DOCUMENTS

| | | | | |
|---|---|---|---|---|
| 5,007,619 | A | 4/1991 | Sibeni | |
| 5,106,058 | A | 4/1992 | Finkelstein | |
| 5,192,109 | A | 3/1993 | Roberts | |
| 5,275,381 | A | 1/1994 | Cluff | |
| 5,395,092 | A | 3/1995 | McClaughlan | |
| 5,622,356 | A | 4/1997 | Duggan | |
| 5,687,957 | A | 11/1997 | Finkelstein | |
| 5,758,868 | A | 6/1998 | Shea | |
| 5,775,676 | A | 7/1998 | Hoggan | |
| 5,806,839 | A | 9/1998 | Meglino | |
| 5,956,920 | A * | 9/1999 | Davis | E04C 3/30 52/236.1 |
| 6,164,628 | A | 12/2000 | Hoggan | |
| 6,357,196 | B1 * | 3/2002 | McCombs | E04C 3/14 138/166 |
| 6,634,623 | B2 | 10/2003 | Torres | |
| 7,207,551 | B2 | 4/2007 | Fielden | |
| 8,511,648 | B2 | 8/2013 | McCarthy | |
| 9,010,069 | B2 | 4/2015 | Bernard | |
| 2007/0138452 | A1 | 6/2007 | Donabedian | |
| 2008/0217598 | A1 | 9/2008 | Dombrowski | |
| 2016/0298357 | A1 | 10/2016 | Liu | |

OTHER PUBLICATIONS

E-Z-Go Divjsion of Textron, Inc., Product Brochure and Video [online], [retrieved Nov. 30, 2016], retrieved from the Internet ,<URL: https://shop.ezgo.com/products/Tinted-Fold-Down-Windshield-Kit-for-E%2540dZ%2540dGO-RXV.html?, pp. 1-2 and video showing sash, struts, or Windshield Attachments and the Windshield Assembly installed onto the canopy struts by way of the Windshield Attachments.

Hurricance Mfg. Co., LLC, Product Brochure [online], [retrieved Nov. 30, 2016], retrieved from the Internet , <URL:http://www.hurricanemfg.com/specifications.php> pp. 1-2 showing installed privacy panels, cross sectional shape of annular member, panel, separate lock, and extender clip, and assembly information.

Hurricance Mfg. Co., LLC, Product Brochure [online], [retrieved Dec. 22, 2016], retrieved from the Internet , <URL:http://www.hurricanemfg.com/home.php; URL:http://www.hurricanemfg.com/home.photo__gallery.php; URL:http://www.hurricanemfg.com/installation.php; and URL:http://www.hurricanemfg.com/contact.php.> general information showing privacy panels and assembly information.

* cited by examiner

TENSIONALLY SECURED SCREENING PANEL

CROSS REFERENCE TO RELATED APPLICATIONS

The following four (4) applications contain subject matter related to the present invention: 1) application Ser. No. 11/393,362 filed on or about Mar. 30, 2006; 2) application Ser. No. 11/642,083 filed on or about Dec. 20, 2006; 3) application Ser. No. 13/645,201 filed on or about Oct. 4, 2012; and 4) application serial number WO 2007/126983 filed on or about Mar. 29, 2007 which are incorporated by reference in their entirety.

FEDERALLY SPONSORED RESEARCH

Not Applicable.

SEQUENCE LISTING OR PROGRAM

Not Applicable.

BACKGROUND OF THE INVENTION

1. Field of the Invention

This present invention relates to screening panels. More specifically, the present invention relates to a panel comprised of an annular member that is tensionally secured to a picket that may be easily installed and removed for optional screening.

2. Description of the Related Art

Screening panels have been known for many years. Such panels are fabricated, cast, molded, and/or extruded and commonly include a set of parts for installation, including adhesives, screws, bolts, rivets, or other similar fasteners.

Various devices that screen fencing are set forth in U.S. patents. U.S. Pat. No. 5,275,381 discloses engagement members that project into fencing and engage respective mounting members positioned within or on the opposite side face of the fencing where the interengagement of the engagement members and mounting members holds the picket member firmly in place. U.S. Pat. No. 5,395,092 discloses U-shaped channels that lie along respective sides of elongate slats that fit over a ridge of knuckles in chain link fencing and engagement members are associated with the channels to secure the screens to knuckles. U.S. Pat. No. 7,207,551 discloses panels that are attached using power tools and self-tapping screws drilled into overlapping panels and pickets.

Other devices have been employed to protect posts. U.S. Pat. Appl. Pub. No. 2007/0138452 discloses a self-retaining post protector made of panels connected by integrally molded reduced cross section hinges, self-retention features inserted through a properly sized slot feature, and inwardly directed flanges that prevent vegetation growth and provide additional strength in the self-retention joint by creating an opposing force. U.S. Pat. No. 5,192,109 discloses a device that attaches windshields to golf carts using a snap-on channel housing with oppositely disposed snap on legs that are snap-attachable to a post in combination with bolts and grommets.

The applicant in U.S. Pat. Appl. Pub. No. 20070138452 also discusses other devices. The applicant explains that the device in U.S. Pat. No. 5,622,356 uses a compressing engagement created by two of three panels that are bowed inward towards each other to provide spring pressure against the post between two of the three panels for the primary means of retention and offers holes for fasteners as a secondary means of attachment. The applicant also explains that U.S. Pat. App. Pub. No. 20050005540 discloses adhesive as a means of securing the respective device to a post. Finally, the applicant explains that the three-sided device of U.S. Pat. No. 5,622,356 may be disengaged from the post upon contact, if the fasteners are not used, and that the adhesive of U.S. Pat. App. Pub. No. 20050005540 adds material cost and may be prone to deterioration that may weaken the respective joint.

Other applications relate to screening panels. Referring to FIGS. 22 and 23, U.S. Pat. App. Pub. No. 2007126983 and FIGS. 18 and 22 and reference numerals therein, discloses a unitary panel where the annular member is received onto a picket with mating contacts that contactingly engage the picket that could rotate or alter the angular position of the panel on the picket under a relatively lesser force when compared to providing a locking member that positively engages the clip in a compressing engagement against the picket.

The related art has shortcomings. Generally, the related art requires the use of adhesives, screws, bolts, rivets, or any other similar fasteners and power tools for installation and removal. Second, apparatuses have multiple interconnecting and interengaging parts. Next, integrally molded devices include notches that create stress risers that may lead to cracking or failure. Finally, the related art includes a range of engagement ranging from loosely contacting to compressing engagement.

The range of engagement leads additional shortcomings. First, in loosely contacting, the panel may rattle, vibrate, or move resulting in a failure to screen, undesirable noise, and a visually unappealing screen. Second, adhesives deteriorate and the panels loosen resulting in detachment, noise, and misalignment. Next, making holes for screws, bolts, rivets, fasteners, connectors, or any or any other similar fasteners or connection leads to corrosion or deterioration of the picket and time-consuming installations that require power tools and special skills. Fourth, devices that use a compressing engagement also require fasteners or new tooling to manufacture each combination of cross section and size of the picket. The panels that include a clip to compressingly engage that latches during handling, shipping, and/or displaying causing the user to unlatch the annular member prior to installation.

The related art also does not provide an annular member that is tensionally secured to the picket. Related art panels are not comprised of an integrally formed panel having a spring that tensions the annular member, an anchor flange that resists movement or slippage as spring tensions annular member, a flexible hinge, and a prying means for receiving a lever and prying force to releasably latch a locking tab and anchor lock for quick installation and removal. Moreover, the prior art does not combine the benefits of an integrally formed panel that does not require: 1) additional machining, trimming, or notching before shipping, 2) adhesives, screws, bolts, rivets, or any other similar fasteners, 3) manufacturing and/or assembly of a set of parts, or 4) new molds or tooling to manufacture each combination of cross section and size of the picket. Finally, the prior art does not resist releasably latching during handling, shipping, or displaying.

SUMMARY OF THE INVENTION

Accordingly, a need has arisen for a panel that overcomes the shortcomings. Generally, in accordance with the exemplary embodiments, the present invention provides an integrally formed, as defined below, panel comprising a spring for tensioning the annular member to the picket with a locking tab and an anchor lock that releasably latch to tensionally secure the annular member to the picket that does not require the assembly of a set of parts or power tools, adhesives, screws, bolts, rivets, or any other similar fasteners or compression or interference fits for attachment and that resists releasably latching during handling, shipping, and/or displaying, and includes a prying means that aids in installation and removal.

It is desirable to adapt fences and structures to optionally prevent the passage of light, sight, children, pets, or objects of a of a general or predetermined shape or size around waste dumpsters, garbage cans, air conditioning or other equipment, retail shops, airports, homes, buildings, stairs, decks, balconies, swimming pools, vehicles and other similar structures. The present invention contemplates adaptation to fences and other structures having various pickets, ballasters, posts, tubing, and struts and is capable of receiving, engaging, tensionally securing, and/or releasing the picket.

Accordingly, an object of the present invention is to provide a panel that can be integrally formed, easily manufactured in a predetermined length, and installed without any additional, trimming, notching, or cutting, except to the extent that a user desires to customize the panel or join it in tandem or side-by-side relation to other panels. Another object is to provide for easy manufacturing, shipping, installation, and removal and to include a structure that resists releasably latching during handling, shipping, and/or displaying. It is also an object to provide a structure for easy installation and removal that does not require the use of adhesives, screws, bolts, rivets, or any other similar fasteners or power tools for attachment to the picket.

The annular member is tensionally secured to the picket with a spring and a locking tab and an anchor lock that releasably latch to tensionally secure the annular member to the picket. This mechanical connection is maintained under wind, snow, thermal, and other forces and spring configurations that vary the tension in the annular member. The user may apply forces to the prying means or other elements to releasably latch the mechanical connection by hand or a lever such as a screwdriver, putty knife, blunt object or other similar devices. In addition to providing an annular member that is capable of receiving, engaging, tensionally securing, and/or releasing the picket, several elements of the present invention cooperate with each other to resist releasably latching during handling, shipping, and/or displaying.

Manufacturers, parcel services, online retailers, and homeowners will appreciate the present invention because they can fully, partially, and removably screen a stair rail, balcony, a baby bed, stair gate, a golf cart, or other similar features of a structure as well as a fenced yard or other area. Golf cart manufacturers will appreciate the present invention because it eliminates drilling, punching, or making holes in struts as well as bolting and related labor costs to install windshields on golf carts. These groups will also find the present invention advantageous because the panel does not require any alteration when leaving the manufacturing facility; and, it may be ordered, boxed, and shipped direct to the end user saving intermediate storage, transportation, and labor costs. The present invention can be manufactured and shipped as a kit for a project in predetermined lengths and joined in tandem with H-clips or in a side-by-side, spaced apart, or overlapping relation with extender clips. While alteration is not required, users will also appreciate that the present invention may be manufactured in predetermined lengths and configurations that may be quickly trimmed, notched, or customized with a jig and a handsaw, band saw, circular saw, and/or or miter saw, or by scoring and snapping.

Users will find the present invention advantageous. The present invention is tensionally secured to the picket. Therefore, the present invention does not include or depend on a separate set interlocking parts, separate latches or locks, or separate screens wedged or compressed between adjacent annular members and does not require adhesives, screws, bolts, rivets, or any other similar restraints, and/or compression or interference fits between the annular member and the picket, separate locks or support by a horizontal rail, floor, ground, or other object or structure. Costs are also lower because the present invention resists releasably latching during handling, shipping, and/or displaying and does not require special packing, cardboard blocks or other similar objects, or allowances to resist locking.

Users will also find the present invention safe and cost effective. The present invention does not require special skills or power tools for installation or removal. A typical user can install the present invention by hand. Additionally, the present invention accommodates a range of tension and the user's strength in two (2) scenarios of installation and removal: 1) with the lever or 2) without the lever. Therefore, children can work with parents on a family project because special skills are not required; and, children may use the lever to pry against the leverage tab, the plurality of leverage tab slots, the plurality of corner slots, and/or the leverage channel, the extension, and/or the plurality of extension slots to tension the annular member and/or install or remove the panels. Moreover, safety is an important aspect. Accommodating a range of user strength that does not require power tools, fasteners, or adhesives reduces the risk of injuries. The present invention is cost effective perspective because the panel is reusable. Users can also improve the safety of their homes by installing the present invention on stairs and/or baby or child gate or pet gates. Finally, the present invention may be installed or removed during seasonal changes or times when a user desires to change the passage of light, sight, children, pets, or objects of a predetermined shape or size.

Decorative, protective, or corrosion coatings, paint, or designs may be applied to the present invention. While persons of all ages are attracted to these decorative designs, the decorative design is a favorite of children.

Other objects and advantages will become obvious to those skilled in the art from a review of the specification and drawings that other forms may be made within the scope of the present invention.

BRIEF DESCRIPTION OF THE DRAWINGS

A better understanding of the invention can be obtained when the detailed description of exemplary embodiments set forth below is considered in conjunction with the attached drawings in which.

DETAILED DESCRIPTION OF THE EXEMPLARY EMBODIMENTS

For purposes of the present description, the term "integrally formed" means that the present invention is made of a continuous, non-segmented, and unitary construction where all elements extend longitudinally and are joined together upon the exit from a mold or tooling, and the present invention is not made by a structural integration such as welding, gluing, bolting, fastening, riveting, screwing or otherwise similarly structurally integrating any elements. The term "integrally formed" does not mean that that the present invention cannot be trimmed, notched, or customized or that the present invention cannot be altered by drilling or punching holes or slots or connected in tandem or in a side-by-side relation for screening.

Figure 1:
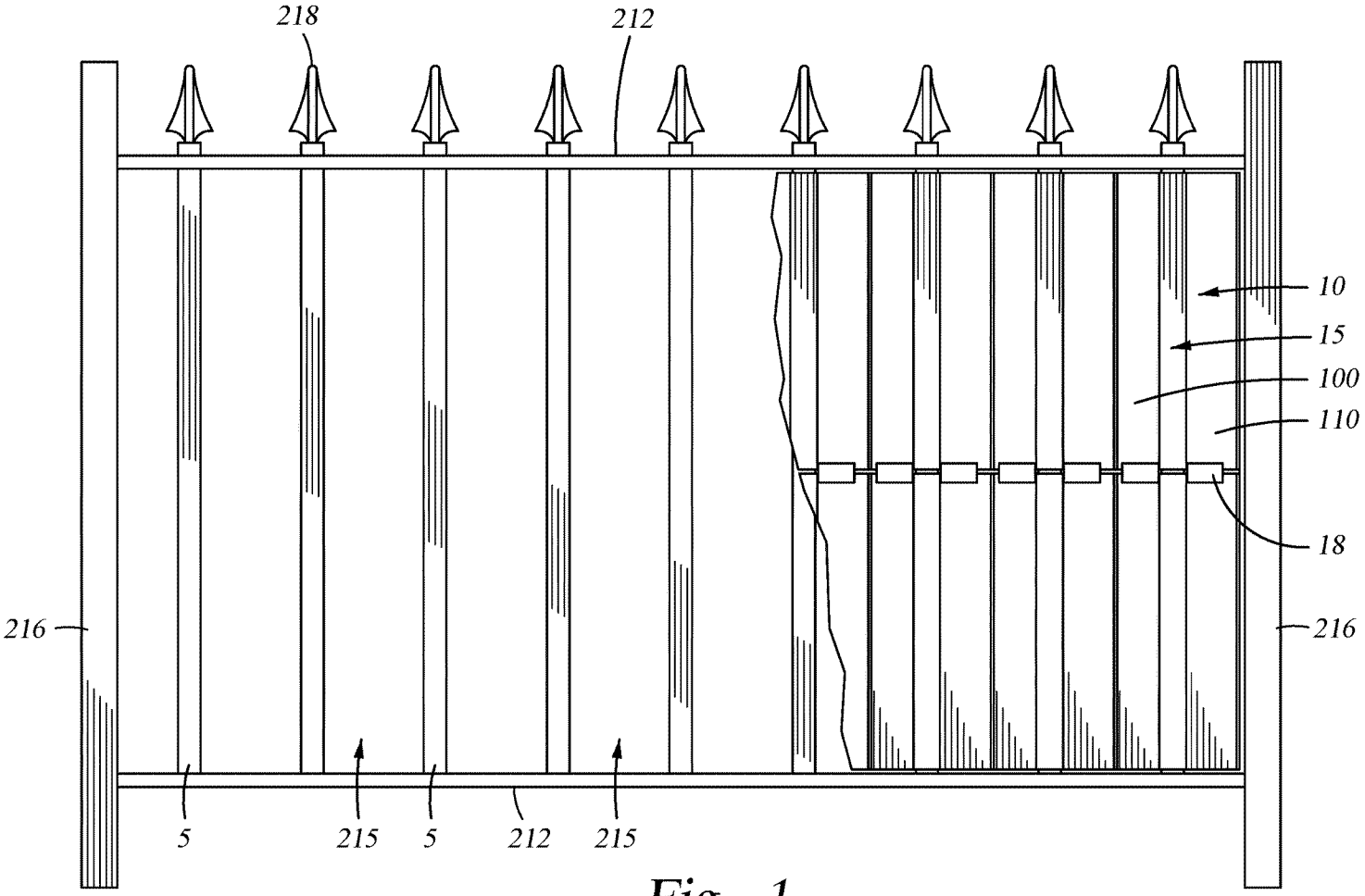
FIG. 1 is an elevational view of a portion of a conventional picket fence of a type that is suitable for adaptation by the present invention and adapted with panels in a tandem and side-by-side, overlapping relation.
Figure 2:
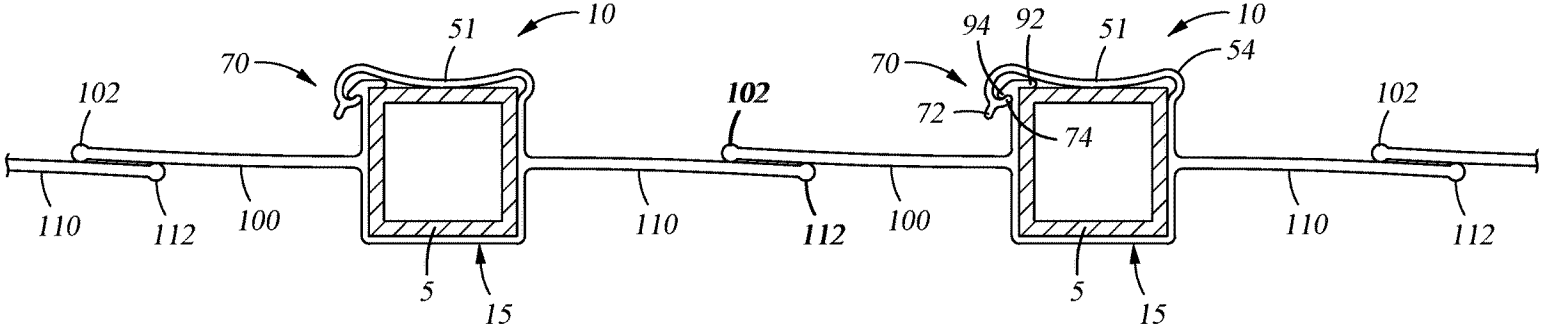
FIG. 2 is a top view of the present invention tensionally secured to pickets in a side-by-side, overlapping relation.
Figure 3:
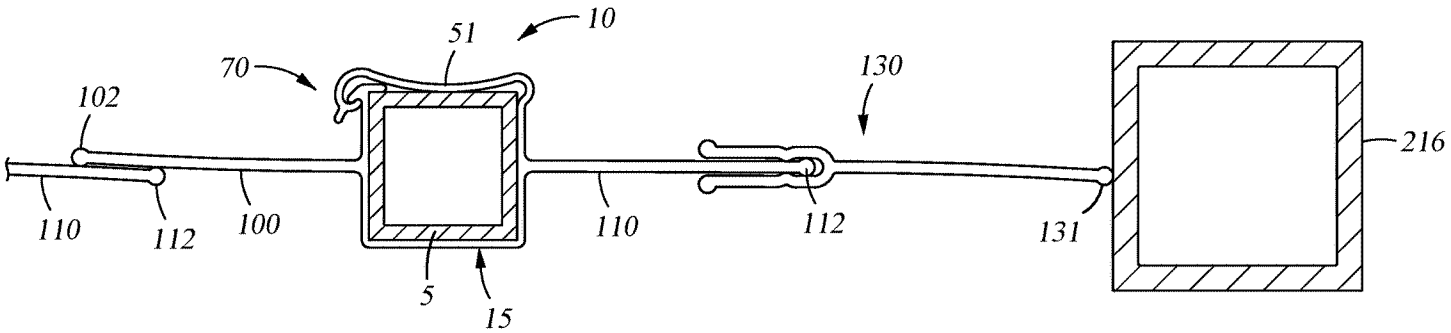
FIG. 3 is a top view of the present invention tensionally secured to pickets in a side-by-side relation with extender clips.

Generally, referring to the drawings, and particularly to FIG. 1, a segment of a conventional picket fence 210 is shown. Typically, a conventional picket fence 210 is constructed by excavating a hole. Posts 216 are placed in the hole with compacted soil, concrete, or other materials to provide a structural member for attachment of a plurality of rails 212. Generally, the conventional picket fence 210 is a structure supporting the plurality of rails 212 arranged in a substantially parallel spaced apart relationship that connect and support the pickets 5. The plurality of rails 212 may also be attached to other structures, buildings, other types of fences, or walls and other similar structures. The predetermined positions of the pickets 5 define a space 215 between pickets 5 that are spaced apart. Referring again to FIG. 1, the pickets 5 have ornamental end pieces 218. Referring to FIGS. 1, 2, and 3, and all figures generally, pickets 5 typically have a substantially square cross section of one-half (½), five-eighths (⅝), three-quarters (¾), and/or one (1) inch or more and the present invention is suitable to receive, engage, tensionally secure, and/or release oversized and undersized pickets 5.

Figure 4:
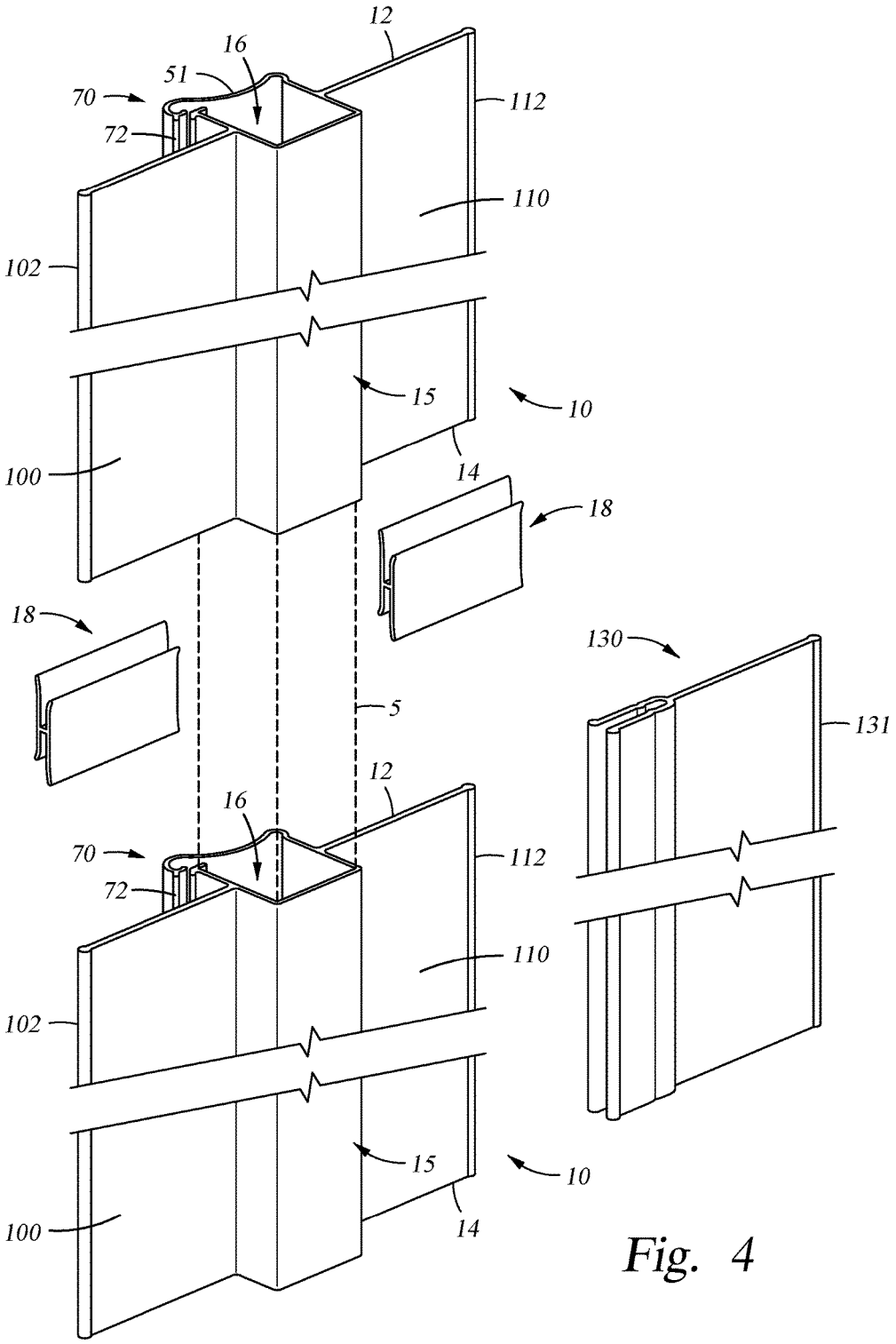
FIG. 4 is a perspective view of the present invention showing a tandem and side-by-side relation.

In accord with one embodiment of the present invention, a panel 10 is illustrated in FIGS. 2-9, and 12-21. FIGS. 4, 7D, and 8C, shows panel 10 received onto a picket 5. FIGS. 2, 3, 6, 7E, and 8D shows panel 10 tensionally secured to picket 5.

Referring to FIGS. 2 and 3, and all figures generally, panel 10 is integrally formed and comprises an annular member 15 defining a longitudinally extending cavity 16 for engaging picket 5. Referring to FIGS. 2-4, 7-8, 15-17, annular member 15 has a substantially square cross section. Annular member 15 is made of any suitable material described herein and may be adapted to any cross section that substantially matches the cross section of picket 5 to be received, engaged, tensionally secured, and/or released. Annular member 15 may have a variable or a uniform thickness, and, by definition, hinge 54 defines the minimum thickness of annular member 15. Preferably, referring to FIGS. 2-20, annular member 15 has a substantially square cross section and a substantially uniform thickness. Manufacturing is typically less complex and costs are lower where annular member 15 has a substantially uniform thickness.

Annular member 15 includes several other elements. Referring to FIGS. 2 and 4, annular member 15 has a longitudinally extending slot 21 in communication with longitudinally extending cavity 16 for receiving and releasing picket 5. Referring to FIGS. 2, 3, 5-12, 15, and 18-21, and all figures generally, annular member 15 includes a locking tab 74 and an anchor lock 94 along opposite sides of longitudinally extending slot 21 for releasably and tensionally securing annular member 15 to picket 5, and anchor lock 94 extends away from longitudinally extending cavity 16 and projects angularly from the adjoining portion of annular member 15 and locking tab 74 extends toward anchor lock 94. Referring to FIGS. 2-6, 9, 11, 13, 14, and all figures generally, annular member 15 includes a prying means 70 for receiving a lever 230 and prying force to releasably latch locking tab 74 to anchor lock 94 ("prying means 70"). Next, referring to FIGS. 2-20, and all figures generally, annular member 15 includes at most one hinge 54 between locking tab 74 and anchor lock 94 for flexibly opening annular member 15 to receive and release picket 5, at most one corner 55 adjacent locking tab 74 for cooperating with hinge 54 to open annular member 15 to receive and release picket 5, and a spring 51 for tensioning annular member 15 to picket 5. Referring to FIGS. 5 and 18-21, spring 51 is between corner 55 and hinge 54. Referring to FIGS. 2-20, annular member may also include an anchor flange 92 adjacent anchor lock 94 extending into longitudinally extending cavity 16 for anchoring annular member 15 to picket 5 and for resisting releasably latching locking tab 74 to anchor lock 94 during handling, shipping, or displaying. Referring to FIGS. 2-4, panel 10 includes at least a first distal panel 100 extending away from longitudinally extending cavity 16 for screening.

Figure 5:
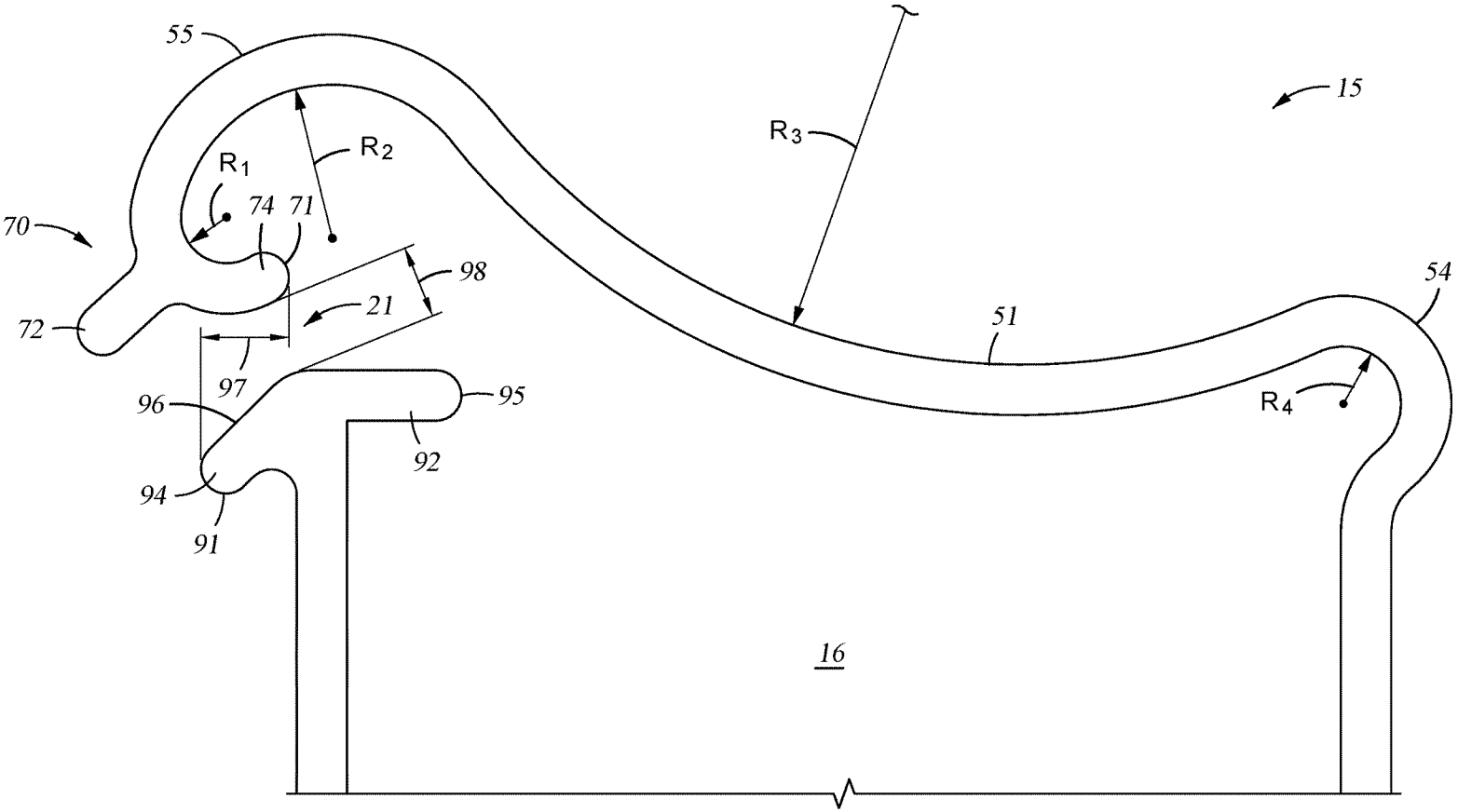
FIG. 5 is a partial cross sectional top view of the annular member.
Figure 12:
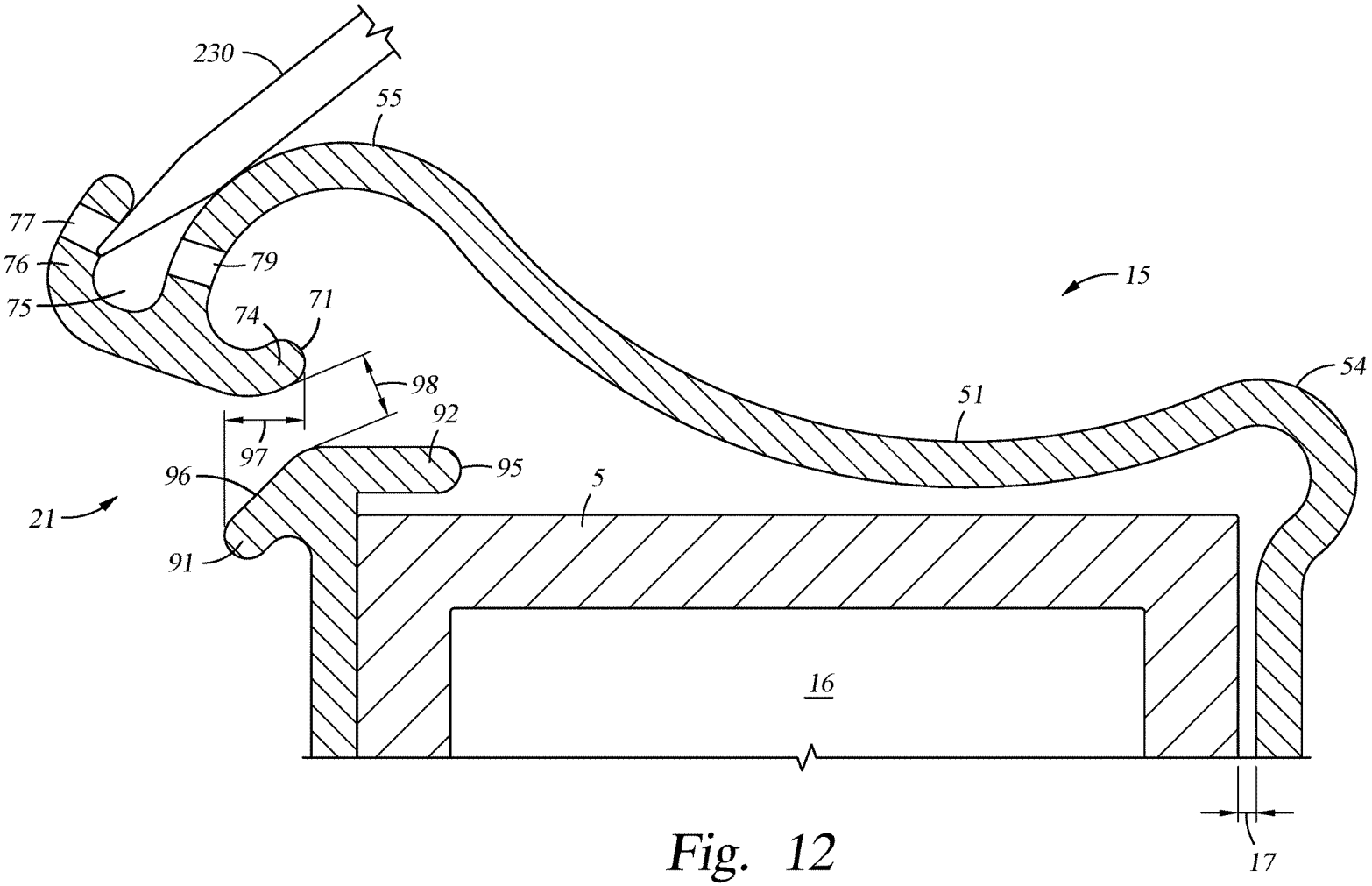
FIG. 12 is a partial cross sectional top view of the picket received into annular member where the prying means comprises the leverage channel, the plurality of extension slots, and plurality of corner slots.

Referring to FIGS. 1-4 longitudinally extending slot 21 is open ended and extends the full length of panel 10. Longitudinally extending slot 21 may have a variable width and shape as shown in FIGS. 5 and 12. Preferably, longitudinally extending slot 21 is of a substantially uniform width equal to about one (1) to two (2) times the thickness of hinge 54 and extends substantially parallel to the longitudinal axis of the longitudinally extending cavity 21. Longitudinally extending slot 21 may have a helical or angularly cross section, but these cross sections typically lead to complex and costly molds and tooling; or, alternatively, longitudinally extending slot 21 could be cut into annular member 15.

Referring to FIG. 5, locking tab 74 has a curvilinear cross section with an inside radius, R1. Referring to FIG. 5, and all generally, locking tab 74 is shown having a curvilinear shape; that substantially matches and mates to anchor lock 94; however, locking tab 74 and anchor lock 94 may be of any shape that substantially match and mate to each other that are capable of tensionally securing annular member 15 to picket 5. Referring to FIG. 5, preferably, locking tab 74 has a curvilinear cross section for mating with anchor lock 94 and the inside radius of locking tab 74, R1, should be about two (2) to four (4) times the thickness of hinge 54.

Referring to FIG. 5, preferably, anchor lock 94 has a curvilinear cross section that matches and mates with locking tab 74. Referring to all figures generally, anchor lock 94 extends away from longitudinally extending cavity 16 and projects angularly from to the adjoining portion of annular member 15; however, anchor lock 94 may extend at any angle relative to the adjoining portion of annular member 15, and may have any rectilinear or curvilinear cross section, provided that anchor lock 94 that substantially matches and mates to locking tab 74.

Figure 13:
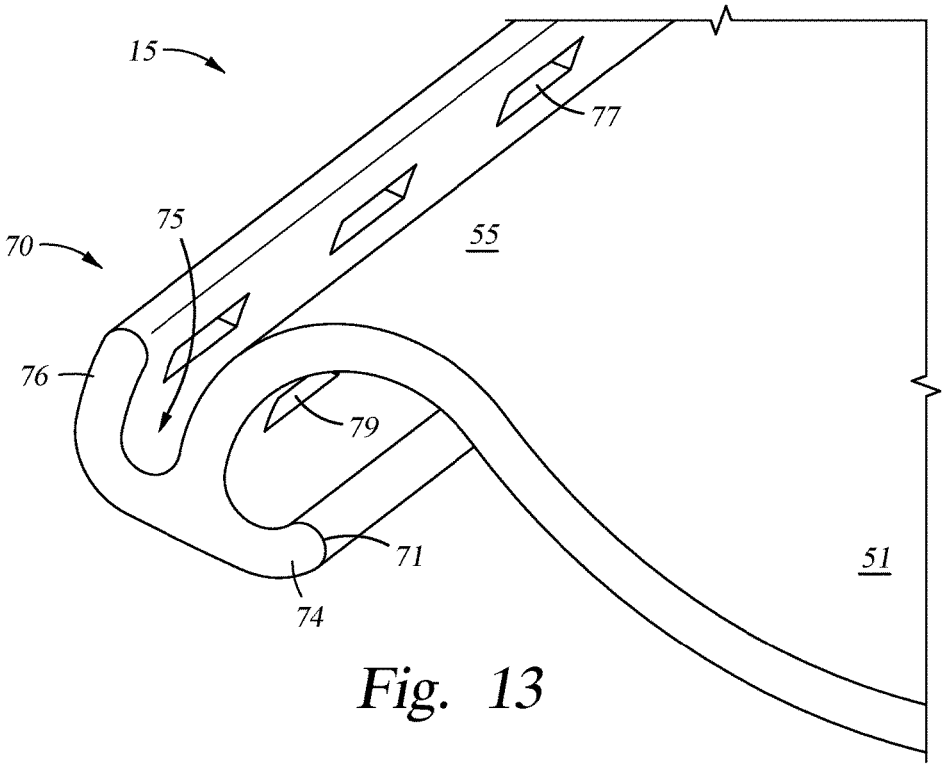
FIG. 13 is a partial perspective view of the prying means comprising the leverage channel, plurality of extension slots, and plurality of corner slots.
Figure 14:
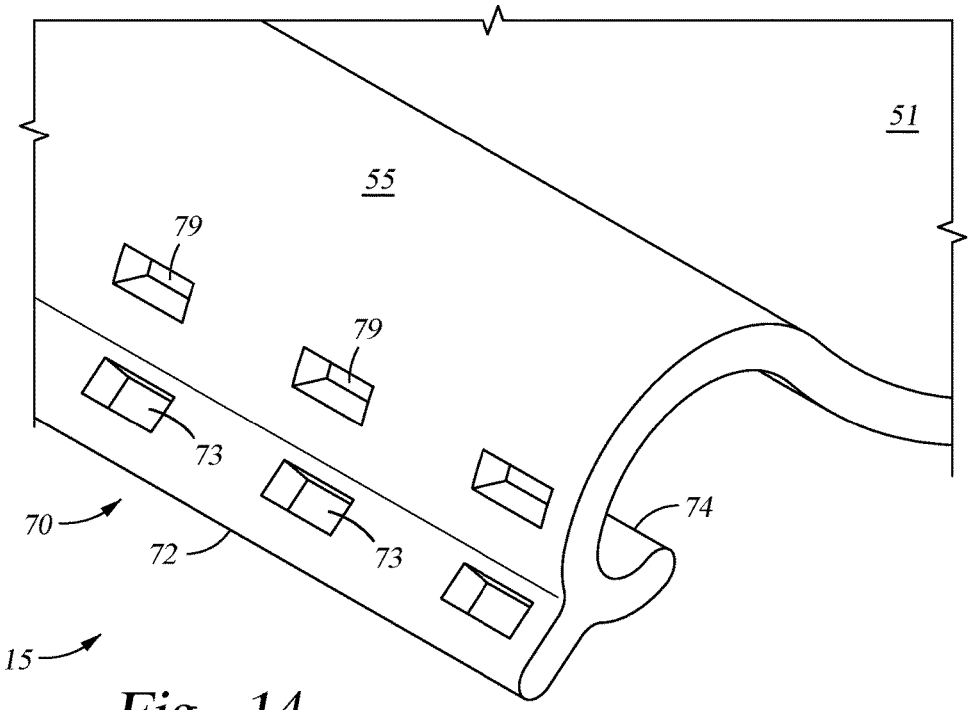
FIG. 14 is a partial perspective view of the prying means comprising the leverage tab, plurality of leverage tab slots, and plurality of corner slots.

Referring to FIGS. 2-6, 9, 11, 13, 14, and all figures generally, annular member 15 includes prying means 70. Referring to FIG. 12, a lever 230 may include devices such as a screwdriver, putty knife, blunt object or other similar devices. Referring to FIGS. 12-14, prying means 70 includes a leverage tab 72, a plurality of leverage tab slots 73, a plurality of corner slots 79, and/or a leverage channel 75, an extension 76, and a plurality of extension slots 77. Leverage tab 72 is suitable to receive and engage the user's hand or thumb or a blunt object. While leverage channel 75, like leverage tab 72 or spring 51 and corner 55, may receive or engage a user's hand or thumb, the lever 230, as shown in FIG. 12, allows the user to apply much larger forces. Additionally, some elements may cooperate with each other to generally facilitate installation and removal and to releasably latch locking tab 74 to anchor lock 94. More specifically, referring to FIGS. 12-14, plurality of leverage tab slots 73 and/or plurality of extension slots 77 may also cooperate with plurality of corner slots 79.

Preferably, referring to FIGS. 1, and 12-14, plurality of leverage tab slots 73, plurality of extension slots 77, and/or plurality of corner slots 79 are of a substantially uniform length and width and spaced apart along leverage tab 72, extension 76, and/or corner 55, respectively, in a predetermined distance of one (1) to three (3) inches and the shortest distance from an edge of plurality of leverage tab slots 73, plurality of extension slots 77, and/or plurality of corner slots 79 to a first distal panel end 12, a second distal panel end 14, an outside edge of corner 55, leverage tab 72, and/or extension 76 should be about one and one-half (1½) to two (2) times the width of plurality of leverage tab slots 73.

Referring to FIGS. 2-9, and all figures generally, leverage tab 72 is along longitudinally extending slot 21 and projecting substantially away from locking tab 74. Referring to FIGS. 2-9, leverage tab 72 may be located at any position along corner 55 projecting away from locking tab 74; however, greater leverage may be applied when leverage tab 72 is adjacent corner 55 or along longitudinally extending slot 21 and projects away from locking tab 74. Additionally, referring to FIG. 5, leverage tab 72 may be of any curvilinear or rectilinear cross section and/or shaped to engage the user's thumb or a device having a blunt surface to receive the force to releasably latch locking tab 74 to anchor lock 94. Referring to 2-9, preferably, leverage tab 72 is along longitudinally extending slot 21 and projects away from locking tab 74 and is substantially perpendicular to the adjacent tangent of corner 55.

Referring to FIG. 14, generally, leverage tab 72 includes plurality of leverage tab slots 73. Plurality of leverage tab slots 73 may be of any shape, size, and spacing to receive and engage the lever 230 to receive the force required to releasably latch locking tab 74 to anchor lock 94.

Next, referring to FIG. 13, corner 55 includes plurality of corner slots 79. Referring to FIGS. 13-14, plurality of corner slots 79 may be of any shape, size, and spacing to receive and engage the lever 230 to receive the force required to releasably latch locking tab 74 to anchor lock 94.

Additionally, referring to FIG. 14, plurality of corner slots 79 may also cooperate with plurality of leverage tab slots 73 where plurality of corner slots 79 substantially match the size, shape, and spacing of plurality of leverage tab slots 73 receive and engage the lever 230 to aid the user in applying force required to releasably latch locking tab 74 to anchor lock 94. More specifically, referring to FIG. 14, plurality of corner slots 79 may cooperate with plurality of leverage tab slots 73 allowing the user to insert the lever 230 through plurality of leverage tab slots 73 and further into plurality of corner slots 79. Referring to FIGS. 13-14, plurality of corner slots 79 are shown substantially the same size, shape, and spacing as plurality of leverage tab slots 73, and plurality of corner slots 79 may vary in size, shape, and spacing from plurality of leverage tab slots 73 to receive the lever 230 with varying or increasing size as shown in FIGS. 13-14. Generally, any plurality of leverage tab slots 73, plurality of corner slots 79, and/or plurality of extension slots 77, or other slots or holes may require drilling, punching, or otherwise making slots or holes after molding, casting, or extruding.

Figure 11:
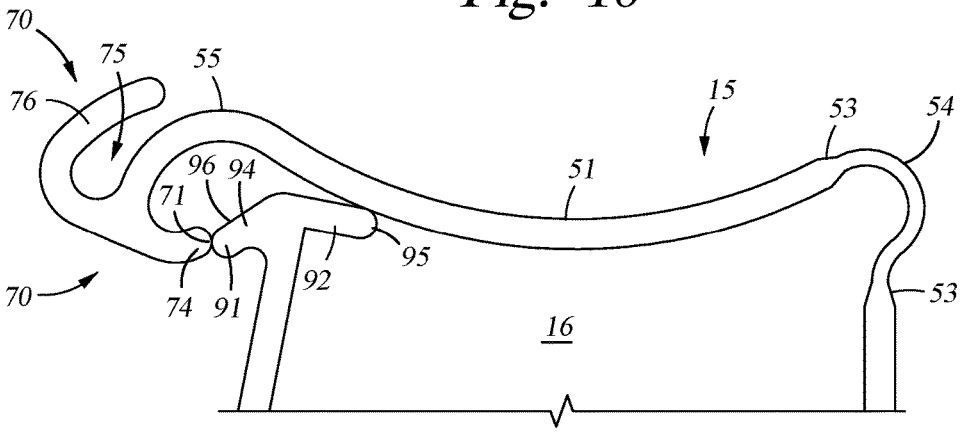
FIG. 11 is a partial cross sectional top view of a third embodiment of the present invention resisting releasably latching.

Next, referring to FIGS. 5, 11-14, and 16-17, leverage channel 75 is defined by an extension 76 along longitudinally extending slot 21 and projecting away from locking tab 74 in a spaced apart relationship to corner 55. In FIG. 12, extension 76 has a substantially L-shaped cross section making leverage channel 75 have a substantially U-shaped cross section. Extension 76 may be of any curvilinear or rectilinear cross section suitable for receiving and engaging the lever 230, and extension 76 may project away from locking tab 74 and extend substantially parallel to and/or be of a substantially similar cross section as corner 55 in a spaced apart relationship to corner 55. In FIG. 11, preferably, prying means 70 is leverage channel 75, where extension 76 is lengthened, compared to FIG. 12, having a substantially L-shaped cross section in a variable spaced apart relationship with corner 55 making leverage channel 75 have a substantially reduced U-shaped cross section.

Additionally, referring to FIGS. 12, 13, and 14, extension 76 includes plurality of extension slots 77 that may cooperate with plurality of corner slots 79 where plurality of corner slots 79 substantially match the size, shape, and spacing of plurality of extension slots 77 receive and engage the lever 230 to aid the user in applying force required to releasably latch locking tab 74 to anchor lock 94.

Figure 10:
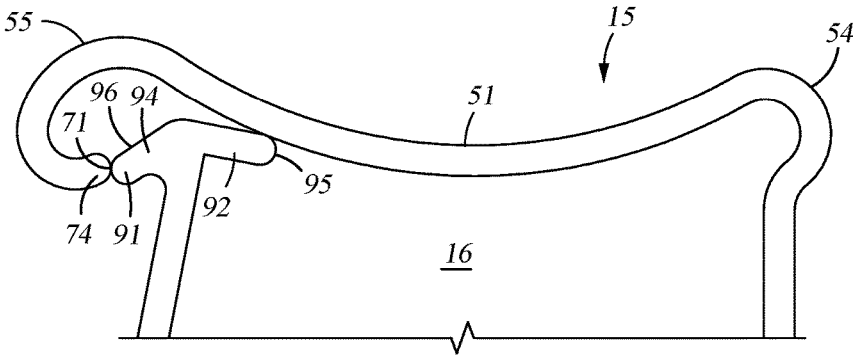
FIG. 10 is a partial cross sectional top view of another the present invention resisting releasably latching.

Next, referring to FIG. 10, the present invention does not include the leverage tab 72 or leverage channel 75 because the prying means 70 may be corner slots 79 where the lever 230 may be used to pry against plurality of corner slots 79 to releasably latch locking tab 74 to anchor lock 94.

Finally, referring to FIGS. 12-14, prying with the lever 230 against leverage tab 72, plurality of leverage tab slots 73, plurality of corner slots 79, and/or leverage channel 75, the extension 76, and/or plurality of extension slots 77, allows the user to rapidly, easily, and conveniently releasably latch locking tab 74 to anchor lock 94, release the tension in annular member 15, and install and/or remove panel 10 from picket 5 during seasonal changes or a times when an user desires to change the passage of light, sight, children, pets, or objects of a predetermined shape or size. This makes panel 10 is reusable because annular member 15 can be disassembled and removed from picket 5.

Next, referring to FIGS. 2-20, and all figures generally, annular member 15 includes at most one hinge 54 between locking tab 74 and anchor lock 94 for flexibly opening annular member 15 to receive and release picket 5. Hinge 54 has a substantially uniform thickness that defines the minimum thickness of annular member 15. Referring to FIGS. 2-20, and all figures generally, hinge 54 has a curvilinear cross section; however, hinge 54 may have a curvilinear or compound curve cross section Referring to FIG. 5, preferably, the inside radius of hinge 54, R4, should be greater than one (1) and is about two (2) to four (4) times the thickness of hinge 54. Preferably, as shown in FIG. 5, hinge 54 is between locking tab 74 and anchor lock 94 and adjacent to spring 51 for flexibly opening annular member 15 to receive and release picket 5.

Next, referring to FIGS. 2-20, and all figures generally, annular member 15 includes at most one corner 55 adjacent locking tab 74 for cooperating with hinge 54 to open annular member 15 to receive and release picket 5. Referring to FIGS. 2-20, and all figures generally, corner 55 has a curvilinear cross section. Referring to FIGS. 5, 7, and 8, corner 55 cooperates with spring 51 and hinge 54 to open annular member 15 to receive and release picket 5. Corner 55 may have any curvilinear or compound curve cross section. Referring to FIG. 5, corner 55 has a curvilinear cross section with one (1) inside radius, R2, and corner 55 is not a compound curve with two (2) radii. Preferably, corner 55 has a single radius curve and is between locking tab 74 and spring 51 as shown in FIG. 5, and the inside radius of corner 55, R2, should be about three (3) to eight (8) times the thickness of hinge 54.

While hinge 54 and corner 55 may be of any curvilinear or compound curve cross section, the curvilinear cross section is preferable and makes manufacturing tooling and/or molds cost effective and sufficiently reduces stress risers and concentrations of stress. Referring to FIG. 5, and all figures generally, preferably, each of corner 55 and hinge 54 have a curvilinear cross section extending outward from longitudinally extending cavity 16. Referring to FIG. 5, the inside radius of hinge 54, R4, is smaller than the inside radius of corner 55, R2; additionally, the inside radius of hinge 54 and corner 55 may vary and they may be equal or may be smaller or larger than the other. Referring to FIG. 5, and all figures generally, preferably, the inside radius of hinge 54, R4, is smaller than the inside radius than corner 55. And, the inside radii of hinge 54, R4, and corner 55, R2, must be greater than one (1) thickness of hinge 54; otherwise, annular member 15 includes a longitudinal notch. Given the reusable nature of the present invention and the tension that may be produced by spring 51, annular member 15 should not include any longitudinal notching for flexibility. Longitudinal notching results in localized thinning and stress risers and concentrations that may result in fatigue, cracking, and rupture of the material.

Rather, in another embodiment of the present invention, referring to FIG. 11, to further increase flexibility and locally reduce the bending stiffness of annular member 15, hinge 54 may have a thickness that is less than the thickness of the annular member 15. Referring to FIG. 11, preferably, annular member 15 has a substantially uniform thickness; and, where additional flexibility is desired, annular member 15 has a transition 53 along each side of hinge 54 for transitioning from the substantially uniform thickness of annular member 15 down to hinge 54 having a substantially uniform thickness that is less than the substantially uniform thickness of annular member 15 for flexibility as shown in FIG. 11. For example, but not in limitation, where annular member 15 has a thickness of about 0.0050 inches, hinge 54 may have a thickness of about 0.0035 inches. Any change in thickness of annular member 15, such as transition 53 where hinge 54 is thinner than annular member 15, should be made with a smooth and gradual transition to prevent stress risers and stress concentrations.

Referring to FIGS. 2, 3, 5, 7B-E, and all generally, annular member 15 includes spring 51 for tensioning annular member 15 to picket 5. Referring to FIGS. 5 and 18-21 spring 51 is between corner 55 and hinge 54. Spring 51 may have a curvilinear, compound curve, or rectilinear cross section.

Referring to FIGS. 2-17, spring 51 has a curvilinear cross section. Referring to FIG. 5, spring 51 has a curvilinear cross section with one (1) inside radius, R3, and spring 51 does not have a compound curve with two (2) radii. Preferably, spring 51 has a curvilinear cross section and an inside radius, R3, of about twelve (12) to twenty (20) times the thickness of hinge 54 and spring 51 extends substantially across the picket 5 to be received as shown in FIG. 5.

Figure 19:
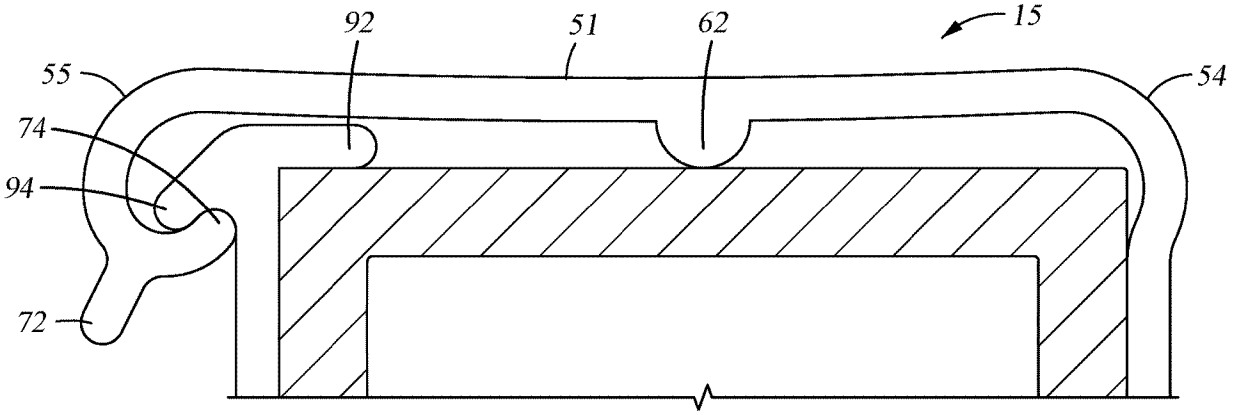
FIG. 19 is a top view of annular member with a spring having a rectilinear cross section where fulcrum means is a lobe having a substantially curvilinear cross section.
Figure 20:
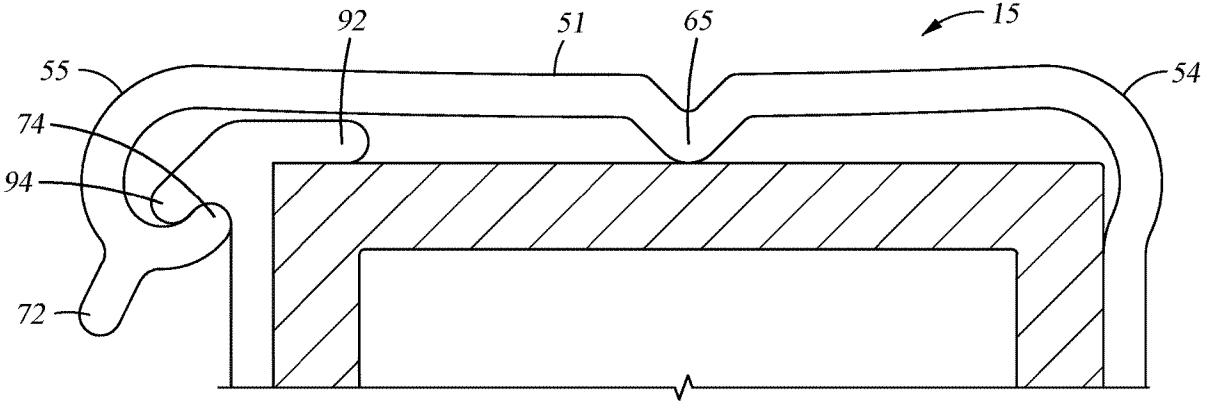
FIG. 20 is a top view of annular member with a spring having a rectilinear cross section where fulcrum means is a detent having a substantially curvilinear cross section.
Figure 21:
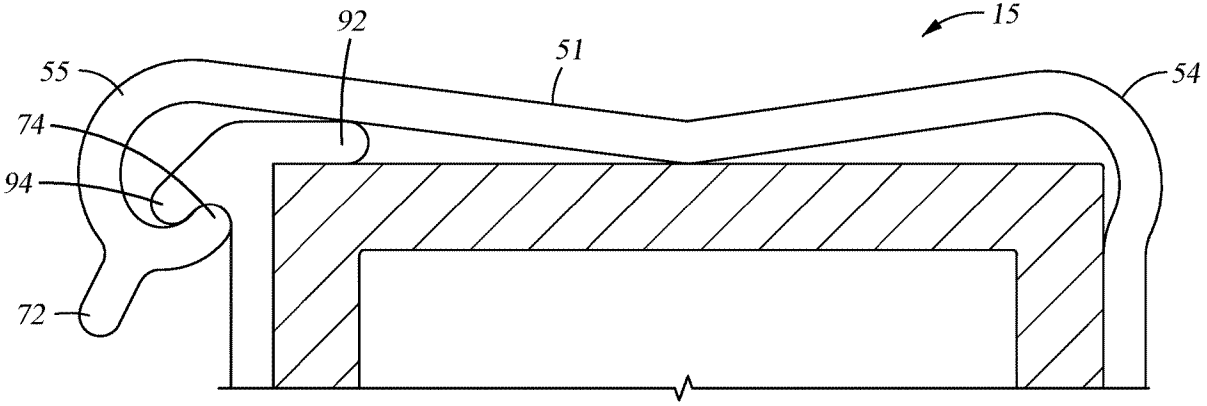
FIG. 21 is a top view of annular member with a spring having substantially V-shaped rectilinear cross section.
Figure 22:
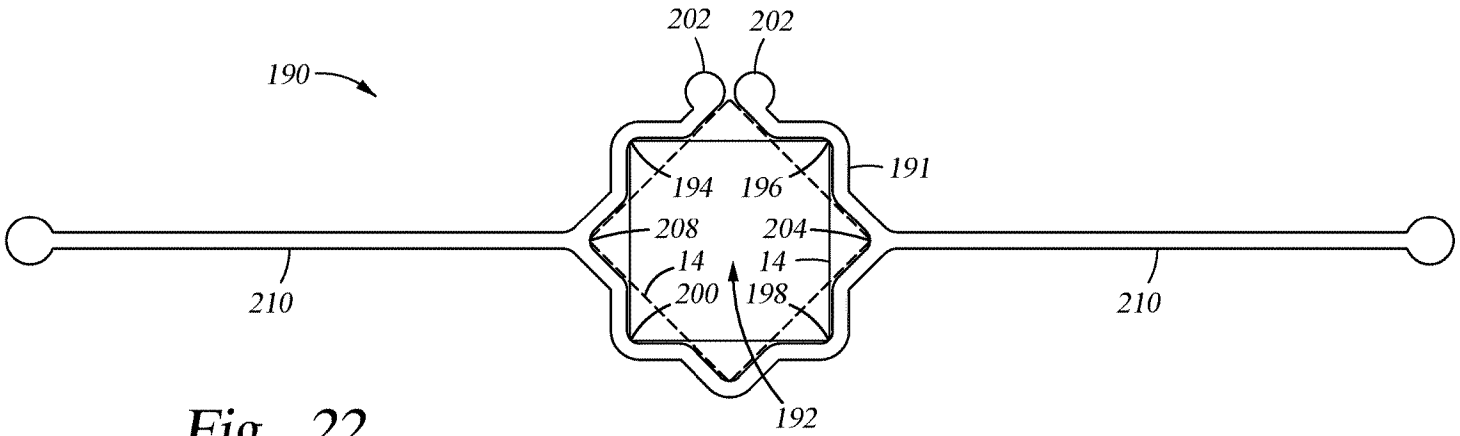
Fig. 22 Prior Art
FIG. 22 is a top view of a related art panel.
Figure 23:
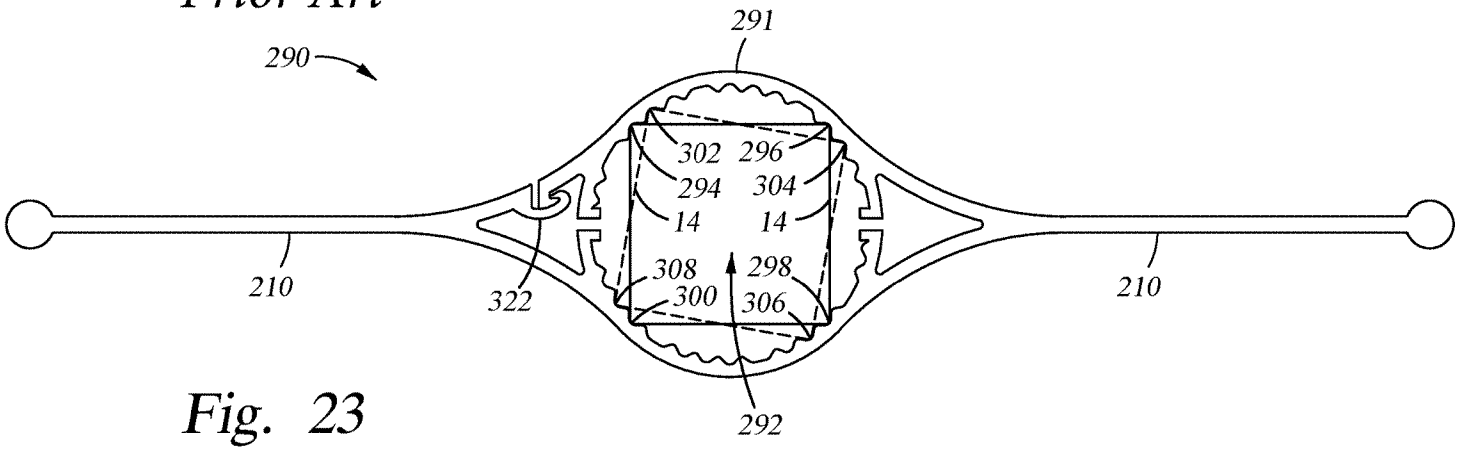
Fig. 23 Prior Art
FIG. 23 is a top view of a related art panel.

Referring to FIGS. 19-21, spring 51 has a rectilinear cross section, and regardless of the cross section, spring 51 may include other elements or cooperate with other elements of the present invention that may act as an additional support or as an additional fulcrum for leveraging to tension annular member 15. Referring to FIGS. 19-21, spring 51 has a rectilinear cross section that includes a fulcrum means 52 for leveraging against picket 5 ("fulcrum means 52") to increase tension in annular member 15 when compared to the same cross section of spring 51 without fulcrum means 52. While FIGS. 19-21 show spring 51 having a rectilinear cross section, the fulcrum means 52 may be included where the spring 51 has a curvilinear cross section as shown in FIGS. 2-17. Referring to FIGS. 19-21, fulcrum means 52 may be a lobe 62, detent 65, groove, substantially U-shaped groove, substantially V-shaped groove, or similar features that contact and provide a fulcrum for leveraging against picket 5 to increase tension in annular member 15. Referring to FIGS. 19-21, lobe 62, detent 65, groove, substantially U-shaped groove, substantially V-shaped groove, or similar features extend toward longitudinally extending cavity 16. Preferably, referring to FIG. 19, fulcrum means 52 is the lobe 62 having a substantially curvilinear cross section. Finally, where a manufacturer has made molds or tooling to manufacture panel 10, the molds or tooling may be most likely modified cost effectively by adding the fulcrum means 52; however, modifying tooling may not be as cost effective as new molds or tooling and depends on other factors like the quantity of material, tension, size of order, and other factors.

Figures 15, 16, 17:
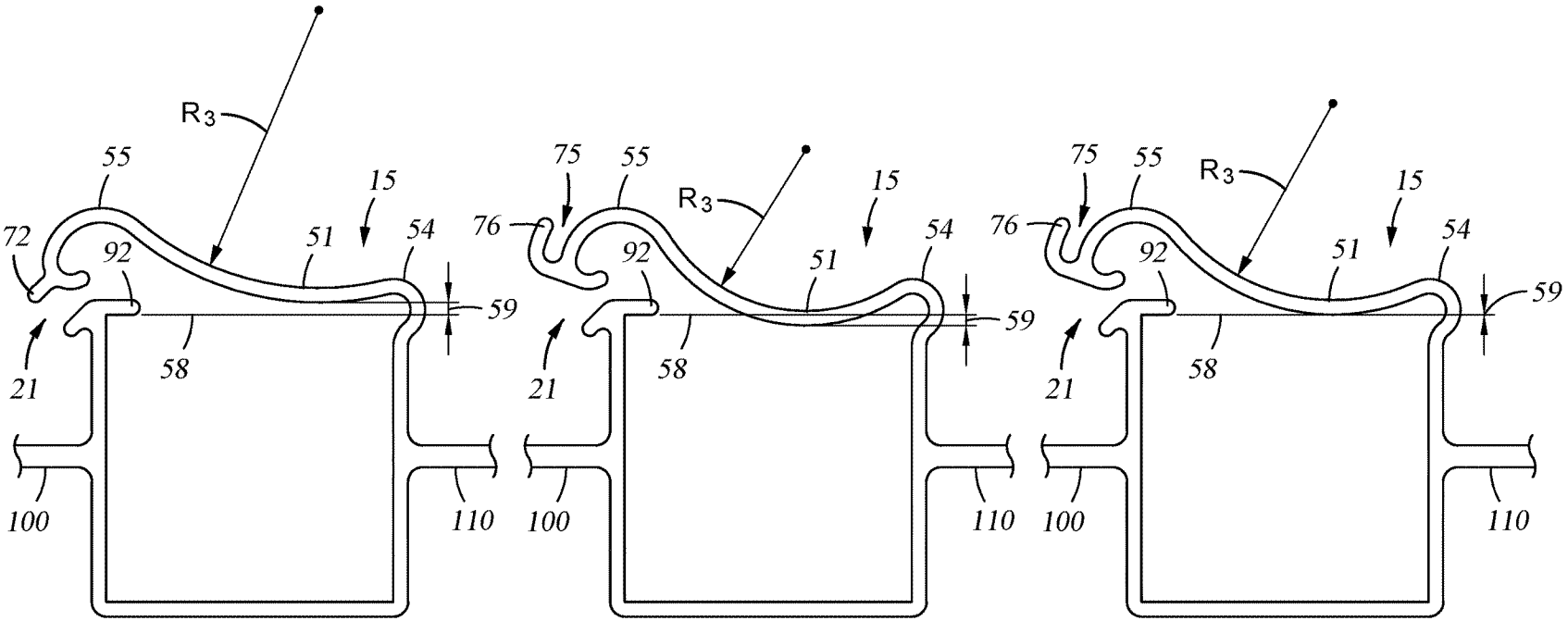
FIG. 15 is a top view of the present invention with a spring having a spring clearance that is positive.
FIG. 16 is a top view of the present invention with a spring having a spring clearance that is neutral.
FIG. 17 is a top view of the present invention with a spring having a spring clearance that is negative
Figure 18:
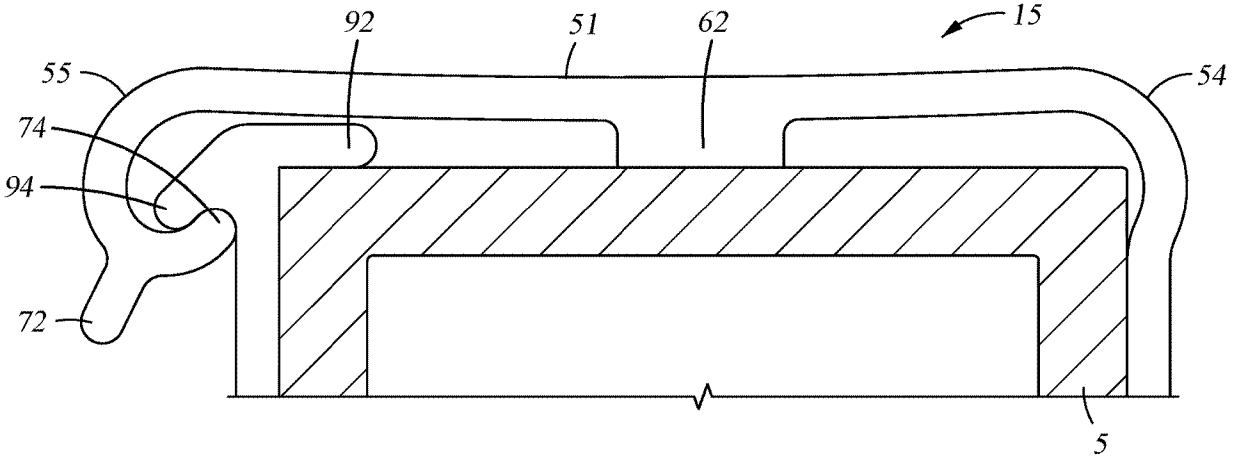
FIG. 18 is a top view of annular member with a spring having a rectilinear cross section where fulcrum means is a lobe having a substantially rectangular cross section.

Clearances related to spring 51 may be understood by referring to FIGS. 15-17. In FIGS. 15-17, where picket 5 is not received into annular member 15, a line projecting from and parallel to the bottom of anchor flange 92 having a rectilinear cross section provides a reference plane 58 that defines a spring clearance 59; or, where anchor flange 92 may have a curvilinear cross section, from and parallel to the tangent of the bottom of anchor flange distal end 95. Referring to FIGS. 15-17, spring clearance 59 is specified by its character as positive, negative, or neutral and/or by a dimension in inches or in proportion to the thickness of hinge 54 and does not include any fulcrum means 52; for example, but not in limitation, negative and/or negative 0.25 inches or about one (1) to three (3) times the thickness of hinge 54. Referring to FIG. 15, spring clearance 59 is positive where spring 51 does not extend to or below reference plane 58. Referring to FIG. 16, spring clearance 59 is negative where spring 51 extends below reference plane 58. Referring to FIG. 17, spring clearance 59 is neutral where spring 51 is tangent to reference plane 58. Referring to FIGS. 15-17; dimensionally, the positive clearance is the shortest perpendicular distance from reference plane 58 to spring 51 and the negative clearance is the longest perpendicular from reference plane 58 that spring 51 extends below reference plane 58. When annular member 15 is tensionally secured, tension is higher in annular member 15 where spring clearance 59 is negative than it would be where spring clearance 59 is neutral or positive. Preferably, spring clearance 59 is positive and dimensionally about one (1) to three (3) times the thickness of hinge 54. Where spring clearance 59 is positive, the user may rotate annular member 15 to a desired position before tensionally securing annular member 15 to the picket 5. Preferably, referring to FIG. 16, prying means 70 is leverage channel 75, where spring 51 has a curvilinear or compound curve cross section and spring clearance 59 is negative.

Referring to FIGS. 5, 9-12, and all figures generally, the present invention includes several elements that cooperate with each other to resist releasably latching locking tab 74 to anchor lock 94. More specifically, referring to FIGS. 5 and 12, anchor lock 94 includes an angular portion 96, and anchor lock 94 and locking tab 74 define a mating lock overlap 97 and locking tab 74, angular portion 96 define an angular offset 98, and the locking tab 74 includes a locking tab distal end 71 and anchor lock 94 includes an anchor lock distal end 91. Angular portion 96 extends from anchor lock distal end 91 to anchor flange 92 and is adjacent longitudinal extending slot 21. With no forces applied to panel 10, referring to FIGS. 5 and 12, mating lock overlap 97 is the dimension, not distance, that locking tab distal end 71 and anchor lock 94 distal end 91 are spaced apart. Referring to FIGS. 5 and 12, angular offset 98 is the shortest perpendicular distance from the angular portion 96 to locking tab 74. The angular offset 96 and mating lock overlap 97 may be any dimension. Preferably, referring to FIGS. 5 and 12, the angular offset 96 and mating lock overlap 97 should be about equal to one (1) thickness of hinge 54. Referring to FIGS. 5 and 12, and all figures generally, preferably, mating lock overlap 97 is such that the locking tab distal end 71 is forced over anchor lock distal end 91 as spring 51 tensions annular member 15. Preferably, referring to FIGS. 9-11, and regardless of whether spring 51 has a rectilinear or curvilinear, or compound curve cross section, the shortest distance between anchor lock distal end 91 and anchor flange distal end 95 is such that anchor flange 92 is contacting spring 51 and simultaneously the anchor lock 92 is contacting the locking tab 74 and resists releasably latching during handling, shipping, and/or displaying.

Referring to FIGS. 15-17, with picket 5 received into annular member 15, annular member 15 and picket 5 define an annular member clearance 17 between the side of longitudinally extending slot 21 that includes the anchor lock 74 and hinge 54. With picket 5 received into annular member 15, the annular member clearance 17 is measured along the portion of annular member 15 between longitudinally extending slot 21 that includes anchor lock 94 and hinge 54 as the longest perpendicular distance from the inside of annular member 15 to the outside surface of picket 5. Preferably, the annular member clearance 17 ranges from a compression or interference fit to about one-fourth (¼) to twenty-five (25) times the thickness of hinge 54 and mating lock overlap 97 and annular member clearance 17 is not so large as to prevent spring 51 from tensioning annular member 15. This range allows spring 51 to tension annular member 15 to a combination of cross sections and sizes of picket 5; and, a single mold or tooling can be used to make annular member 15 capable of tensionally securing to pickets of the same nominal size that vary by schedule, thickness, coating, and outside dimensions. Preferably, where annular member 15 has a substantially square cross section and a substantially uniform thickness of about 0.0050 inches, the annular member clearance 17 ranges from a compression or interference fit to a maximum of about one-eighth (⅛) inch.

Spring 51 is the primary structural member that tensions annular member 15, and varying the curvature or radius of spring 51 and/or spring clearance 59 will vary the tension in annular member 15. Referring to FIGS. 5 and 12, to some extent, the tension in annular member 15 may be varied by changing the cross section of spring 51, corner 55, and/or hinge 54 and/or varying angular offset 98, mating lock overlap 97, and/or annular member clearance 17.

Referring to FIGS. 2-4, and all figures generally, panel 10 may also include elements for screening between spaced apart pickets 5. Referring to FIGS. 2-4, panel 10 includes at least one distal panel 100 extending away from longitudinally extending cavity 16 for screening. Panel 10 having only first distal panel 100, may be used to screen across an adjacent distal panel or to an adjacent post, wall, building, or other object. Next, referring to FIGS. 2-4, annular member 15 may also include a second distal panel 110. In FIGS. 2-4, first distal panel 100 and second distal panel 110 extend away from longitudinally extending cavity 16 and substantially directionally opposite to each other. Referring to FIGS. 2 and 3, while first distal panel 100 and second distal panel 110 are shown substantially centered and substantially perpendicular to the respective portions of annular member 15 from which the first distal panel 100 and second distal panel 110 extend, first distal panel 100 and second distal panel 110 may be offset from each other and offset from being substantially centered in the respective portions of annular member 15 from which the first distal panel 100 and second distal panel 110 extend, and first distal panel 100 and second distal panel 110 may be positioned at any location in annular member 15. Also, first distal panel 100 and second distal panel 110 may extend away from longitudinally extending cavity 16 parallel to each other and/or at any angle relative to each other; or, similar to the cross section of leverage channel 75, first distal panel 100 may also be substantially reverse L-shaped in a spaced apart relationship to the outside of annular member 15 that defines a screen slot 120 for receiving a screen to screen curves in fencing or structures or to define a screen slot 120 for receiving a screen or windshield or similar structure. First distal panel 100 and second distal panel 110 may be of any curvilinear or rectilinear cross section. Screen slot 120 may also include a plurality of ribs 125, perforations, holes, or slots to receive, engage, and attach other screens, devices, and/or decorations, and to allow the passage of light, sight, children, pets, or objects of a predetermined shape or size. Referring to FIG. 3, an extender clip 130 having an extender clip distal end 131 may be attached to second distal end 112 and/or first distal end 100 to extend the screening provided by first distal panel 100 and second distal panel 110. While FIG. 1 shows post 216 and picket 5 having a spacing that differs from the spacing between pickets 5, the spacing between post 216 and an adjacent picket 5 is typically equal to the spacing between pickets 5; and, while extender clip 130 is only slightly curved in FIG. 3 with the extender clip distal end 131 contacting the central portion of post 216, in other spacing of the post 216 and adjacent picket 5, extender clip distal end 131 may contact the post 216 where the extender clip distal end 131 is not substantially centered on post 216 producing a smaller radius of curvature in extender clip 130 and/or the extender clip distal end 131 may extend past post 216.

Figure 9:
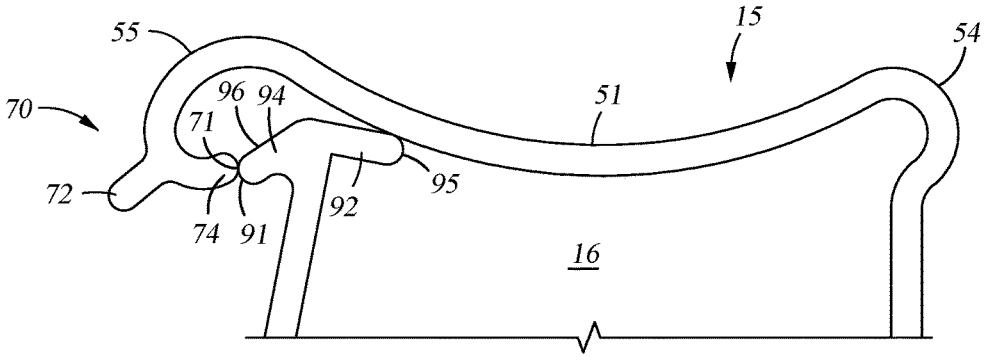
FIG. 9 is a partial cross sectional top view of the present invention resisting releasably latching.

Referring to FIGS. 5, 9-12, and all figures generally, several elements cooperate with each other to resist releasably latching during handling, shipping, and/or displaying. Referring to FIGS. 5 and 12, hinge 54, spring 51, corner 55, and locking tab 74 cooperate with angular portion 96, mating lock overlap 97, angular offset 98, anchor flange 92, and anchor lock 94 to resist releasably latching locking tab 74 to anchor lock 94 during handling, shipping, and/or displaying. Referring to FIGS. 9-12, while forces may be applied in any direction and combination, generally, forces applied to panel 10 during handling, shipping, and/or displaying rotate hinge 54 and deflect spring 51 to cause locking tab 74 to slidably engage angular portion 96. Generally, as locking tab 74 moves along angular portion 96, locking tab 74 and anchor lock 94 are displaced relative to each other as shown in FIGS. 9-11. After locking tab 74 is slidably engaged with angular portion 96, additional forces may be applied to overcome friction and continue to rotate hinge 54 and deflect spring 51 and continue the relative displacement of locking tab 74 and anchor lock 94, until anchor flange 92 is contacting spring 51 and simultaneously anchor lock 94 is contacting locking tab 74 and actively resisting releasably latching as shown in FIGS. 9-11. Next, referring to FIGS. 9-11, and particularly FIG. 12, the user may apply additional force to leverage tab 72 and/or prying means 70 to overcome resisting releasably latching locking tab 74 to anchor lock 94 to cause locking tab 74 to disengage from angular portion 96 as it passes anchor lock distal end 91 and passes under anchor lock 94 to tensionally secure annular member 15 to picket 5. Inserting cardboard blocks or other similar objects in longitudinal extending cavity 16 may supplement resistance to resisting releasably latching or providing an allowance between panel 10 and surfaces of a shipping box and/or display rack may provide additional resistance; however, cardboard blocks increase costs and waste and increasing allowances enlarge the size of the shipping media and the resulting costs.

Referring to FIGS. 1-4, and 7-D, the user may understand the operation to receive, engage, tensionally secure, and release annular member 15. Generally, referring to FIGS. 1, 7-8, the present invention may be installed by two (2) or more methods. Referring to FIG. 1, in one method, where at least one end of picket 5 is accessible and/or where the ornamental end pieces 218 are removably attached to picket 5, or where annular member 15 may receive and pass over non-removably attached ornamental end pieces 218, in general, longitudinally extending cavity 16 may be aligned with the longitudinal axis of picket 5, and annular member 15 may be slipped and slidably pressed over an end of picket 5 and/or any non-removably attached ornamental end pieces 218 and annular member 15 may be slidably moved along picket 5 past any horizontal rail 212 to a predetermined position where picket 5 is received into annular member 15, and forces may be applied to tension annular member 15 and releasably latch locking tab 74 to anchor lock 94.

Referring to FIGS. 7A-E, in another method, the user may begin by generally aligning longitudinally extending cavity 16 with picket 5 with longitudinally extending slot 21 contacting picket 5 in a first relative orientation, applying forces to spread longitudinally extending slot 21 apart, and moving the spread apart annular member 15 over picket 5, and allowing picket 5 to be received into annular member 15. Referring to FIGS. 7A-E, the user may continue to apply force and spread longitudinally extending slot 21 open and slidably receive picket 5 into annular member 15 in a predetermined position and then tensioning and releasably latching locking tab 74 to anchor lock 94.

Next, in another method, referring to FIGS. 8A-D, where panel 10 has includes at least first distal panel 100 and second distal panel 110, the user may, by hand spread longitudinally extending slot 21 apart by applying a biasing force to each of first distal panel 100 and second distal panel 110 and place the spread apart annular member 15 over picket 5 and release the spreading apart forces allowing picket 5 to be received into annular member 15. Spreading apart annular member 15 works well to install the annular member onto pickets 5 having a substantially square cross section. Finally, where annular members 15 may be installed on pickets 5 that are spaced apart with a separate screen pressed into screen slot 120 and received in to a plurality of ribs 125 and with annular member 15 installed on opposite sides of the screen, each respective annular member 15 may be spread apart and received onto pickets 5 that are spaced apart. Preferably, picket 5 is received into annular member 15 by spreading apart annular member 15.

Finally, in any method of installation, with picket 5 received into annular member 15 in a predetermined position relative to plurality of rails 212 or a desired degree of screening, the user applies a force to spring 51 and/or corner 55, and/or prying means 70, tension in annular member 15 increases, and locking tab 74 contacts and slidably engages angular portion 96 and locking tab 74 moves under anchor lock 94 securely tensioning annular member 15 to picket 5.

The release of tension and release of picket 5 from annular member 15 follows a similar process discussed below where the user may release the tension in annular member 15 with or without the lever 230 and spread apart annular member 15 to remove it from picket 5.

Referring to FIGS. 2-20, annular member 15 may optionally include anchor flange 92. Referring to FIGS. 2-20, anchor flange 92 is adjacent to anchor lock 94 and extends into longitudinally extending cavity 16 for anchoring annular member 15 to picket 5 and resisting releasably latching locking tab 74 to anchor lock 94. Referring to FIGS. 2-5, anchor flange 92 is substantially perpendicular to the adjoining portion of annular member 15 and extends away from locking tab 74; however, anchor flange 92 may extend at any angle relative to the adjoining portion of annular member 15, and have any rectilinear or curvilinear cross section, provided that anchor flange 92 substantially matches the shape of picket 5 in the region where anchor flange 92 engages picket 5 and that anchor flange 92 resists movement or slippage on picket 5 as spring 51 tensions annular member 15.

Figure 6:
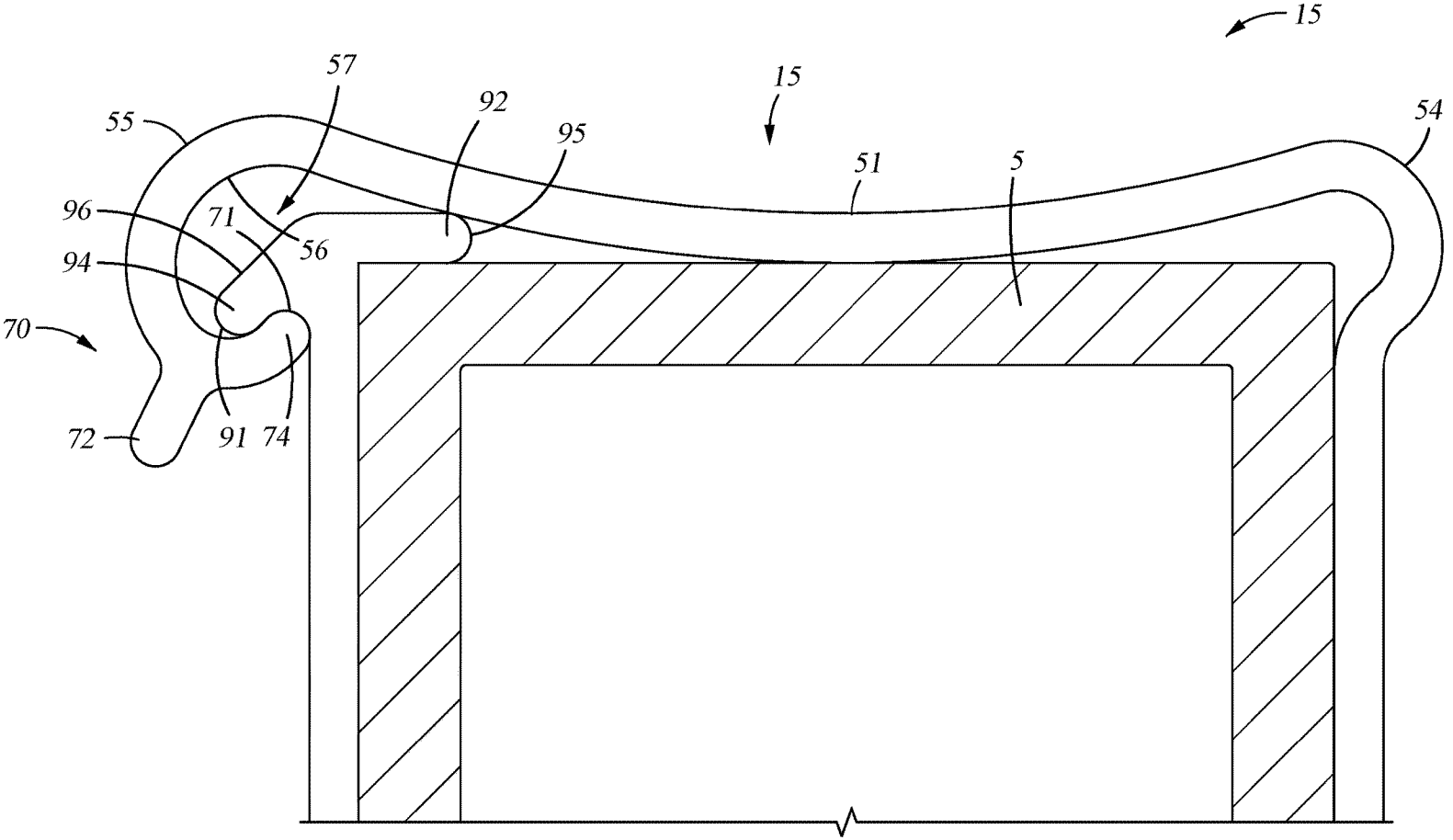
FIG. 6 is a partial cross sectional top view of another embodiment of the annular member securely tensioned to the picket.
Figure 7A:
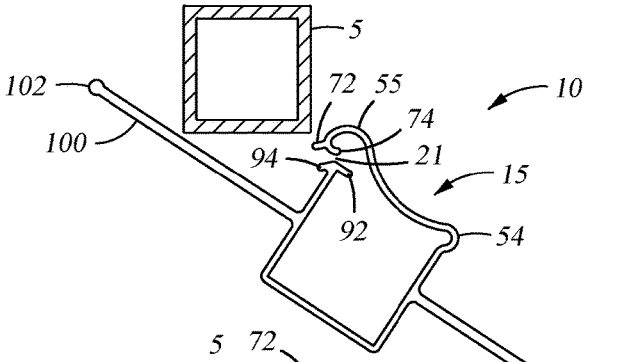
FIGS. 7A-E is a top view showing one method of receiving the picket into annular member and securely tensioning the annular member to the picket.
Figure 7B:
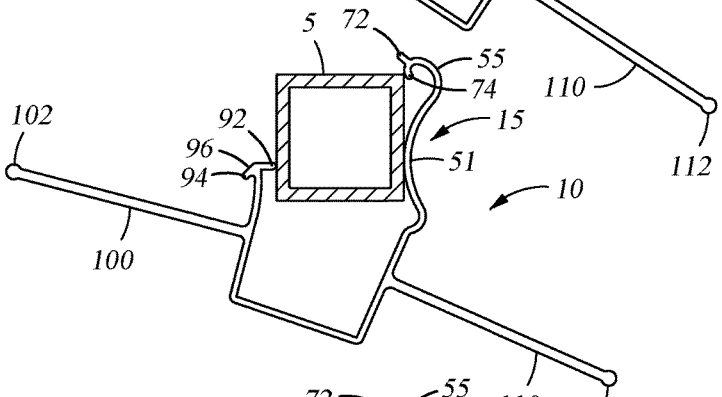
Figure 7C:
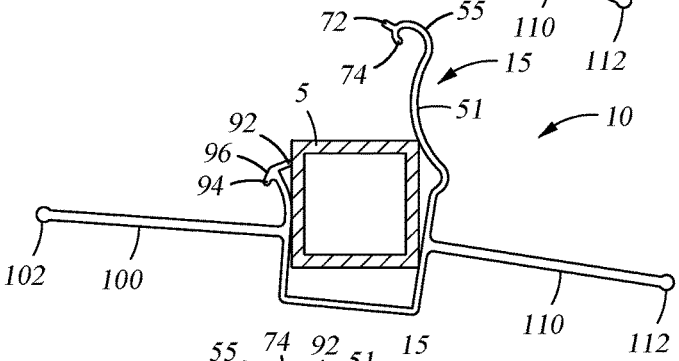
Figure 7D:
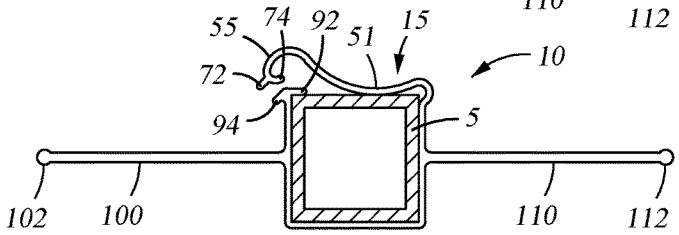
Figure 7E:
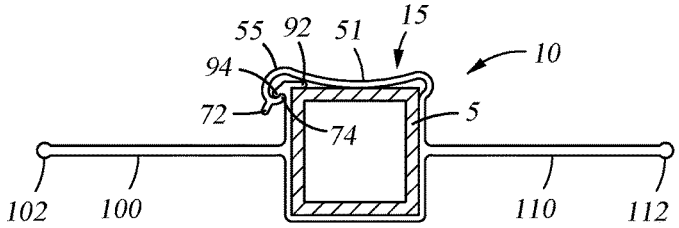
Figure 8A:
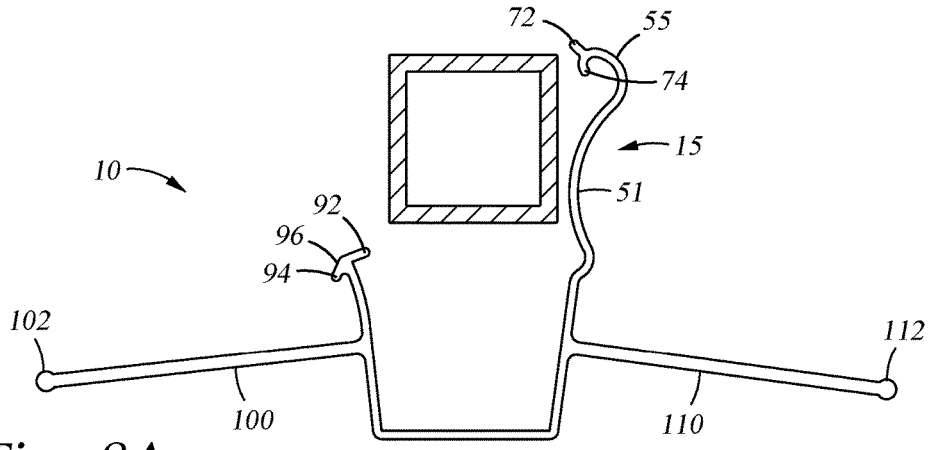
FIGS. 8A-D is a top view showing another method of receiving the picket into annular member and securely tensioning the annular member to the picket.
Figure 8B:
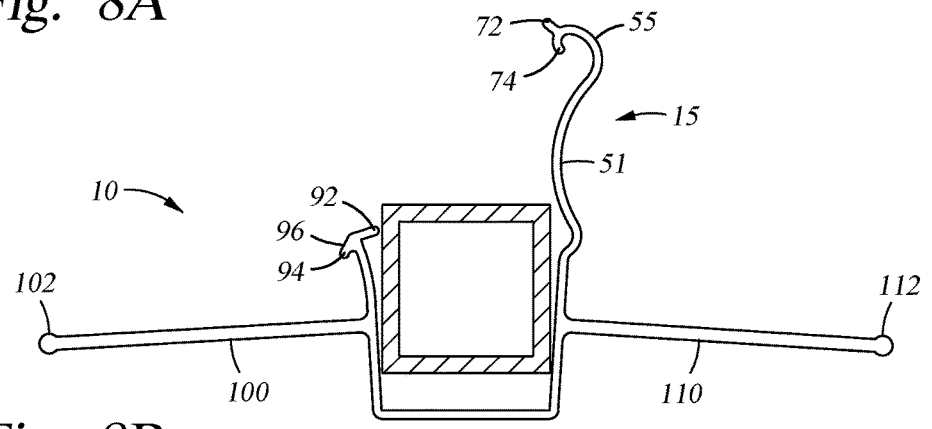
Figure 8C:
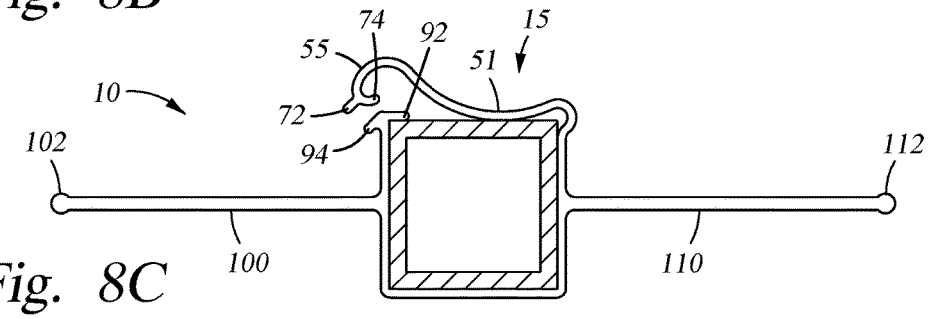
Figure 8D:
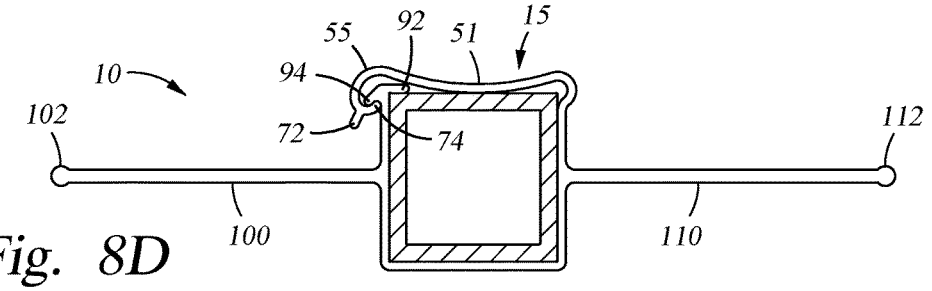

Comparing FIGS. 6, 7E, and 8D with 18-19, annular member 15 may be adapted for anchor flange 92 to optionally contact spring 51 when annular member 15 is tensionally secured to picket 5. However, the tension in annular member 15 may be increased by extending anchor flange 92 to contact spring 51 when annular member 15 is tensionally secured to picket 5. In FIGS. 6, 7E, and 8D, anchor flange 92 contacts spring 51, and acts as a fulcrum between spring 51 and picket 5 to increase the tension in annular member 15. Similarly, the arrangement of spring 51 and corner 55 may be such that anchor flange 92 contacts corner 55. Preferably, annular member 15 includes anchor flange 92, and anchor flange has a rectilinear cross section that contacts spring 51 cooperating with other elements to resist releasably latching during handling, shipping, and/or displaying and when annular member 15 is tensionally secured to picket 5. Spring 51 is not required to contact anchor flange 92; in FIGS. 18-19, anchor flange 92 does not contact spring 51.

Preferably, anchor flange 92 contacts spring 51 and/or corner 55 as annular member 15 is securely tensioned to picket 5 as shown in FIG. 6, and corner 55 includes a corner inside surface 56, and the inside surface 56, and the angular portion 96, anchor flange 92, and spring 51 and/or corner 55 define a corner clearance 57 for reducing stresses as forces are applied to prying means 70 to releasably latch locking tab 74 to anchor lock 94.

Additionally, referring to FIGS. 2-20, anchor flange 92 is not required where the cross section of annular member 15 will sufficiently engage picket 5 and allow the user to tension annular member 15. However, where anchor flange 92 is included, it beneficially engages picket 5 and anchors annular member 15 to the picket allowing the user to apply larger forces and higher tension in annular member 15 when compared to the absence of anchor flange 92. Generally, referring to FIGS. 4, and 7-8, pickets 5 having rectilinear cross sections such as triangles, squares, rectangles, polygons or other rectilinear shapes provide a corner, edge, or edges that sufficiently engage picket 5 to anchor and resist movement or slippage on annular member 15 as spring 51 tensions annular member 15.

The present invention provides for a range in the strength of the user in two (2) scenarios of installation and removal: 1) with the lever 230 or 2) without the lever 230. In either scenario, the installation process follows the above-described methods, and the rectilinear shape of picket 5 and/or anchor flange 92 engage picket 5 to resist slippage of annular member 15 on or around picket 5 as the user applies forces.

Where the user does not require the lever 230, with picket 5 received in annular member 15, the user may apply forces by hand to spring 51 and/or corner 55 to overcome resisting releasably latching locking tab 74 and to releasably latch locking tab 74 to anchor lock 94 and tensionally secure annular member 15 to picket 5. In this scenario, to release the tension in annular member 15, the user applies forces to spring 51, corner 55, and/or prying means 70 to releasably latch locking tab 74 to anchor lock 94.

On the other hand, where the user requires the lever 230, referring to FIG. 12, the lever 230 is received into prying means 70 and as the user uses prying means 70 to apply forces to overcome resisting releasably latching locking tab 74 to anchor lock 94 as shown in FIGS. 9-11 and to releasably latch locking tab 74 to anchor lock 94 and tensionally secure annular member 15 to picket 5. In this scenario, to release the tension in annular member 15, the user applies forces to prying means 70 to releasably latch locking tab 74 to anchor lock 94 and spreads annular member 15 apart and removes it from picket 5. Generally, any lever 230 will suffice, and a putty knife works well to release tension where the prying means 70 is the leverage channel 75.

All parts of panel 10 may be integrally formed of a suitable material as required for carrying out the invention. Generally, elastomeric or polymeric material, including, but not limited to polyvinylchloride ("PVC") or other vinyl material, is sufficiently flexible and capable of sufficiently tensioning annular member 15, and elastomeric or polymeric materials are suitable materials for extrusion and other forming methods of manufacture discussed in this application, but any materials with a similar properties are suitable for carrying out the present invention.

PVC may include certain additives to further improve the present invention. Anti-oxidants and other stabilizers may be beneficial to slow or reduce the rate at which the polymer will be degraded by oxygen, heat, visible light or ultra violet radiation; compatibilizers may be used to include other plastics and recycled plastics to be mixed with PVC; flame retardants may also be added to reduce flammability; pigments may be added to customize the color; and plasticizers may be added to change or modify the properties of the PVC; impact modifiers may be added to absorb shock and avoid chipping; and fillers may be used to further reduce manufacturing costs.

All parts of panel 10 may be integrally formed by casting, molding, or extruding. Generally, mold and tooling costs increase with increasing complexity. Preferably, panel 10 is manufactured by extruding PVC through extrusion molds or tooling. PVC provides a high strength and wear resistant material at lower price than most other materials. Rigid PVC with a Shore D or type D hardness of eighty-one (81) plus or minus three (3) or about seventy-eight (78) to eighty-four (84) works well to make the present invention. The Shore D hardness may be determined in accordance with American Society for Testing Materials Designation: D2240-15 Standard Test Method for Rubber Property Durometer Hardness, where the number immediately following the designation indicates the year of original adoption or, in the case of revision, the year of last revision, published January 2016, which is incorporated by reference in its entirety and other similar standards or procedures for determining the hardness of materials.

Generally any decorative, protective, or corrosion coatings or paint may be applied to the present invention. Panel 10 may include a decorative design. Frequently, decorative designs are of trademarks, servicemarks, names, characters, animals, and other flora and fauna. While persons of all ages are attracted to these decorative designs, the decorative design is a favorite of children.

Panel 10 is commonly placed on a single picket 5, and panels 10 may be placed on pickets that are spaced apart and may cooperate with each other in side-by-side relation for additional screening. Panel 10 may also be placed on a single or pickets 5 that are spaced apart a predetermined distance to provide for the passage of light, sight, children, pets, or objects of a predetermined shape or size. Referring to FIGS. 1-2, panel 10 may also be attached at a predetermined distance along the picket 5, shown by dashed lines, for a tandem connection with another panel 10 to extend the length of the obstruction created in a fence. Referring again to FIGS. 1-2, an H-clip 18 may be inserted between any two (2) panels 10 that attach in tandem. In FIG. 1, H-clip 18 is shown preferably extending substantially from the outside of annular member 15 to first distal panel end 102 and/or second distal panel end 112; however, H-clip 18 may be of any size suitable to receive and retain the panel 10 in a tandem relation.

Referring to FIGS. 1-3, panel 10 may be manufactured in a predetermined length and width. Generally, referring to FIG. 1, the length of panel 10 should be between thirty-six (36) and forty-eight (48) inches from first distal end 102 to second distal end 112. This range of lengths is common in parcel shipping, adequately screens most pickets 5, and may be readily manufactured and shipped directly to the user. Generally, the width of panel 10 may vary according to the spaced apart distance of pickets 5, and the adjacent first distal end 102 and second distal end 112 should overlap each other from the adjacent panel 10 to provide full screening between pickets 5 spaced apart as shown in FIG. 1. The width of panel 10 may be limited by the manufacturing process; and, in particular, where panel 10 is manufactured in an extrusion molding process the width of panel 10 is limited to about eight (8) to ten (10) inches.

To the extent that the user desires, panel 10 may be trimmed, notched, or customized. Users may choose from several methods to cut or trim panel 10, including a hand-saw, band saw, circular saw, and/or miter saw, or by scoring and snapping. Depending on the material, and while certain additives may reduce chipping, in general, reversing the blade on a band saw, circular saw, and/or miter saw will reduce chipping of PVC and other materials and will most likely be one of the more effective methods for cutting or trimming panel 10.

First, with regard to reducing the width, users may desire to trim or cut the first distal panel 100 to create the desired level of screening or to accommodate uneven spacing between pickets 5 that are spaced apart, an adjacent post, wall, building, or other object. Users may find it helpful to make a jig or pattern to cut the distal panels that is adapted to slidably engage annular member 15 and guide a saw to make longitudinal cuts.

Next, with regard to notching, users may desire to modify panel 10 where picket 5 has a curvature that would cause buckling, distortion, or yielding of panel 10 or where a horizontal rail 212 may cause buckling, distortion, or yielding of panel 10. Referring to FIG. 1, and all figures generally, if the user desires screening such that panel 10 is longer than the span between horizontal rails 212, annular member 15 may be partially removed or notched such that the horizontal rail 212 does not interfere with the attachment of panel 10 to picket 5 or contact picket 5. Similarly, where the user desires to install panel 10 on picket 5 having a curvature that would cause bucking or yielding of panel 10, the user may cut notches in one side or each side of annular member 15.

Additionally, users may desire to reduce the length of panel 10. Referring to FIG. 1, assuming that users desire to screen the area between the horizontal rails 212 or less, at a minimum, users should measure from the bottom of uppermost horizontal rail 212 to the top of lower horizontal rail 212, and subtract one-quarter (¼) inch to determine the cut length to allow for thermal expansion of panel 10.

Finally, users may desire to install panel 10 on picket 5 and make the panel 10 non-removable. Users may score the leverage channel 75 and/or the leverage tab 72 and snap it away from annular member 15 leaving the annular member 15 securely tensioned to picket 5.

All patents and publications referred to herein are hereby incorporated by reference in their entireties.

Having described the invention above, various modifications of the techniques, procedures, materials, components, elements, and equipment will be apparent to those skilled in the art. It is intended that all such variations within the scope and spirit of the invention be included within the scope of panel 10 described in the claims.

What is claimed is:

1. An integrally formed panel comprising:

an annular member defining a longitudinally extending cavity for engaging a picket;

at least a first distal panel extending away from said longitudinally extending cavity for screening;

said annular member further comprising:

a longitudinally extending slot in communication with said longitudinally extending cavity for receiving and releasing said picket;

a locking tab and an anchor lock along opposite sides of said longitudinally extending slot for releasably and tensionally securing said annular member to said picket, said anchor lock extending away from said longitudinally extending cavity and projecting angularly from the adjoining portion of said annular member, and said locking tab extending toward said anchor lock;

a prying means for receiving a lever and prying force to releasably latch said locking tab to said anchor lock; said prying means adjacent to said locking tab and extending away from said longitudinally extending cavity;

a hinge between said locking tab and said anchor lock for flexibly opening said annular member to receive and release said picket;

a corner adjacent said locking tab for cooperating with said hinge to open said annular member to receive and release said picket;

a spring between said corner and said hinge for tensioning said annular member; and an anchor flange adjacent said anchor lock extending into said longitudinally extending cavity for anchoring said annular member to said picket;

whereby as forces are applied to said integrally formed panel, said spring, said corner, and/or said prying means, said locking tab may be deflected toward said anchor lock, and as forces and related deflections increase, said locking tab contacts said anchor lock and resists releasably latching during handling, shipping, or displaying; and whereby said picket may be received into said annular member and said anchor flange may be engaged to said picket, and as forces are applied to said spring, said corner, and/or said prying means, said spring is deflected toward said picket and said locking tab is deflected toward said anchor lock while said anchor flange resists movement or slippage on said picket as said spring starts to tension said annular member, and as forces are increased and deflections increase and as said anchor flange continues to resist movement or slippage on said picket, the tension continues to increase and said locking tab contacts said anchor lock and resists releasably latching, and as other additional forces are applied to overcome resisting releasably latching, the tension further increases as said locking tab passes under said anchor lock to tensionally secure said annular member to said picket.

2. The integrally formed panel as claimed in claim 1, wherein said prying means for receiving a lever and prying force to releasably latch said locking tab to said anchor lock is a leverage channel defined by an extension along said longitudinally extending slot and projecting away from said locking tab in a spaced apart relationship to said corner.

3. The integrally formed panel as claimed in claim 2, wherein said spring for tensioning said annular member has a curvilinear cross section and a spring clearance that is positive.

4. The integrally formed panel as claimed in claim 3, wherein:

said corner has a curvilinear cross section extending outward from said longitudinally extending cavity; and said hinge has a curvilinear cross section extending outward from said longitudinally extending cavity.

5. The integrally formed panel as claimed in claim 4, wherein:

said hinge and said corner each having an inside radius and the inside radius of said hinge is smaller than the inside radius of said corner; and said spring for tensioning said annular member further comprises a fulcrum means for leveraging against said picket to increase tension in said annular member.

6. The integrally formed panel as claimed in claim 5, wherein:

said annular member has a substantially uniform thickness; and said annular member has a transition along each side of said hinge for transitioning from the substantially uniform thickness of said annular member down to said hinge having a substantially uniform thickness that is less than the substantially uniform thickness of said annular member for flexibility.

7. The integrally formed panel as claimed in claim 6 wherein said leverage channel has a substantially reduced U-shaped cross section.

8. The integrally formed panel as claimed in claim 7 wherein said integrally formed panel is made of PVC.

9. The integrally formed panel as claimed in claim 8, wherein said PVC is rigid having a Shore D hardness of about eighty-one plus or minus three.

10. An integrally formed panel comprising:

an annular member defining a longitudinally extending cavity for engaging a picket;

at least a first distal panel extending away from said longitudinally extending cavity for screening;

said annular member further comprising:

a longitudinally extending slot in communication with said longitudinally extending cavity for receiving and releasing said picket;

a locking tab and an anchor lock along opposite sides of said longitudinally extending slot for releasably and tensionally securing said annular member to said picket, said anchor lock extending away from said longitudinally extending cavity and projecting angularly from the adjoining portion of said annular member, and said locking tab extending toward said anchor lock;

a prying means for receiving a lever and prying force to releasably latch said locking tab to said anchor lock; said prying means adjacent to said locking tab and extending away from said longitudinally extending cavity;

a hinge between said locking tab and said anchor lock for flexibly opening said annular member to receive and release said picket;

wherein said annular member has a transition along each side of said hinge for transitioning from a substantially uniform thickness of said annular member down to said hinge having a substantially uniform thickness that is less than the substantially uniform thickness of said annular member for flexibility;

a corner adjacent said locking tab for cooperating with said hinge to open said annular member to receive and release said picket; said corner has a curvilinear cross section extending outward from said longitudinally extending cavity and said hinge has a curvilinear cross section extending outward from said longitudinally extending cavity;

a spring between said corner and said hinge for tensioning said annular member;

an anchor flange adjacent said anchor lock extending into said longitudinally extending cavity for anchoring said annular member to said picket;

whereby as forces are applied to said integrally formed panel, spring, said corner, and/or said prying means, said locking tab may be deflected toward said anchor lock, and as forces and related deflections increase, said locking tab contacts said anchor lock and resists releasably latching during handling, shipping, or displaying; and whereby said picket may be received into said annular member and said anchor flange may be engaged with said picket, and as forces are applied to said spring, said corner, and/or said prying means, said spring is deflected toward said picket and said locking tab is deflected toward said anchor lock while said anchor flange resists movement or slippage on said picket as said spring starts to tension said annular member, and as forces are increased and deflections increase and as said anchor flange continues to resist movement or slippage on said picket, the tension continues to increase and said locking tab contacts said anchor lock and resists releasably latching, and as other additional forces are applied to overcome resisting releasably latching, the tension further increases as said locking tab passes under said anchor lock to tensionally secure said annular member to said picket.

11. The integrally formed panel as claimed in claim 10 wherein:

said prying means for receiving a lever and prying force to releasably latch said locking tab to said anchor lock is a leverage channel defined by an extension along said longitudinally extending slot and projecting away from said locking tab in a spaced apart relationship to said corner.

12. The integrally formed panel as claimed in claim 10 wherein:

said prying means for receiving a lever and prying force to releasably latch said locking tab to said anchor lock is a leverage tab along said longitudinally extending slot and projecting substantially away from said locking tab.

13. The integrally formed panel as claimed in claim 12 wherein:

said spring for tensioning said annular member further comprises a fulcrum means for leveraging against said picket to increase tension in said annular member.

14. The integrally formed panel as claimed in claim 13 wherein:

said spring for tensioning said annular member has a rectilinear cross section.

15. The integrally formed panel as claimed in claim 14 wherein:

said fulcrum means is a lobe extending toward said longitudinally extending cavity.

16. The integrally formed panel as claimed in claim 13 wherein:

said spring for tensioning said annular member has a curvilinear cross section.

17. The integrally formed panel as claimed in claim 16 wherein:

said fulcrum means is a lobe extending toward said longitudinally extending cavity.

18. The integrally formed panel as claimed in claim 17 wherein:

said spring for tensioning said annular member has a spring clearance that is positive, said integrally formed panel is made of PVC, said PVC is rigid having a Shore D hardness of about eighty-one plus or minus three.

19. An integrally formed panel made of PVC comprising:

an annular member defining a longitudinally extending cavity for engaging a picket;

a first distal panel and a second distal panel each substantially centered and substantially perpendicular to the respective portions of said annular member from which the first distal panel and second distal panel extend for screening; said first distal panel and said second distal panel extending away from each other and said longitudinally extending cavity;

said annular member further comprising:

a longitudinally extending slot in communication with said longitudinally extending cavity for receiving and releasing said picket;

a locking tab and an anchor lock along opposite sides of said longitudinally extending slot for releasably and tensionally securing said annular member to said picket, said anchor lock extending away from said longitudinally extending cavity and projecting angularly from the adjoining portion of said annular member, and said locking tab extending toward said anchor lock;

a prying means for receiving a lever and prying force to releasably latch said locking tab to said anchor lock; said prying means adjacent to said locking tab and extending away from said longitudinally extending cavity;

a hinge between said locking tab and said anchor lock for flexibly opening said annular member to receive and release said picket, wherein said hinge has an inside radius that is greater than one thickness of said hinge;

a corner adjacent said locking tab for cooperating with said hinge to open said annular member to receive and release said picket, wherein said corner has a curvilinear cross section extending outward from said longitudinally extending cavity and said hinge has a curvilinear cross section extending outward from said longitudinally extending cavity, said corner has an inside radius greater than one thickness of said hinge and about three to eight times the thickness of said hinge;

a spring between said corner and said hinge for tensioning said annular member; and an anchor flange adjacent said anchor lock extending into said longitudinally extending cavity for anchoring said annular member to said picket and for resisting releasably latching said locking tab to said anchor lock during handling, shipping, or displaying, said anchor flange adapted for contacting said spring and providing additional support for leveraging to increase the tension in said annular member and tensionally secure said annular member to said picket;

whereby as forces are applied to said integrally formed panel, said spring, said corner, and/or said prying means, said locking tab may be deflected toward said anchor lock, and as forces and related deflections increase, said anchor flange contacts said spring and simultaneously said locking tab contacts said anchor lock and resists releasably latching during handling, shipping, or displaying; and whereby said picket may be received into said annular member and said anchor flange may be engaged to said picket, and as forces are applied to said spring, said corner, and/or said prying means, said spring is deflected toward said picket and said locking tab is deflected toward said anchor lock while said anchor flange resists movement or slippage on said picket as said spring starts to tension said annular member, and as forces are increased and deflections increase and as said anchor flange continues to resist movement or slippage on said picket, the tension continues to increase and said anchor flange contacts said spring and simultaneously said locking tab contacts said anchor lock and resists releasably latching, and as other additional forces are applied to overcome resisting releasably latching, the tension further increases as said locking tab passes under said anchor lock and said anchor flange contacts said spring providing additional support for leveraging to increase the tension in said annular member and tensionally secure said annular member to said picket.

20. An integrally formed panel as claimed in claim 19 wherein:

said spring for tensioning said annular member has a curvilinear cross section and a spring clearance that is positive and dimensionally about one to three times the thickness of said hinge;

said corner includes a plurality of corner slots;

said prying means for receiving a lever and prying force to releasably latch said locking tab to said anchor lock comprises a leverage channel defined by an extension along said longitudinally extending slot and projecting away from said locking tab in a spaced apart relationship to said corner, said leverage channel having a substantially reduced U-shaped cross section, and said extension includes a plurality of extension slots for cooperating with said plurality of corner slots that substantially match the size, shape, and spacing of said plurality of extension slots for receiving and engaging the lever to releasably latch said locking tab to said anchor lock; and said PVC is rigid having a Shore D hardness of about eighty-one plus or minus three.

* * * * *